US008950996B2

(12) United States Patent
Hilton

(10) Patent No.: US 8,950,996 B2
(45) Date of Patent: Feb. 10, 2015

(54) PIPE HANDLING APPARATUS AND METHOD

(75) Inventor: Thomas Dale Hilton, Laurel, MS (US)

(73) Assignee: Warrior Energy Services Corporation, Houston, TX (US)

( * ) Notice: Subject to any disclaimer, the term of this patent is extended or adjusted under 35 U.S.C. 154(b) by 124 days.

(21) Appl. No.: 13/548,048

(22) Filed: Jul. 12, 2012

(65) Prior Publication Data

US 2013/0336748 A1 Dec. 19, 2013

Related U.S. Application Data

(63) Continuation-in-part of application No. 13/523,238, filed on Jun. 14, 2012.

(51) Int. Cl.
*E21B 19/14* (2006.01)
*E21B 19/15* (2006.01)
*E21B 19/00* (2006.01)

(52) U.S. Cl.
USPC ..... 414/22.55

(58) Field of Classification Search
USPC ..... 187/211, 215; 211/150, 188, 108, 221, 211/298, 301, 75; 254/88; 312/42; 414/22.51–22.59, 22.61–22.62
See application file for complete search history.

(56) References Cited

U.S. PATENT DOCUMENTS

| | | | | |
|---|---|---|---|---|
| 2,113,270 | A | 8/1936 | Hall et al. | |
| 2,922,533 | A | 12/1957 | La Barge, Jr. | |
| 3,785,506 | A * | 1/1974 | Crocker et al. | 414/745.8 |
| 3,810,553 | A | 5/1974 | Crocker et al. | |
| 4,403,898 | A * | 9/1983 | Thompson | 414/22.58 |
| 4,470,740 | A | 9/1984 | Frias | |
| 4,486,137 | A | 12/1984 | Buckner | |
| 4,643,273 | A | 2/1987 | Stokoe | |
| 4,684,314 | A * | 8/1987 | Luth | 414/746.1 |
| 5,249,642 | A | 10/1993 | Kishi | |
| 6,079,925 | A | 6/2000 | Morgan et al. | |
| 6,390,762 | B1 * | 5/2002 | Peery et al. | 414/589 |
| 6,488,161 | B1 | 12/2002 | Bean | |
| 6,547,034 | B1 | 4/2003 | Waters | |
| 7,021,880 | B2 | 4/2006 | Morelli et al. | |
| 7,404,697 | B2 * | 7/2008 | Thompson | 414/22.58 |
| 7,614,492 | B2 * | 11/2009 | Muse et al. | 198/468.6 |
| 7,635,249 | B2 | 12/2009 | Guidroz | |
| 7,665,944 | B2 | 2/2010 | Guidroz | |
| 7,832,974 | B2 * | 11/2010 | Fikowski et al. | 414/22.54 |
| 7,883,309 | B2 * | 2/2011 | Smith et al. | 414/22.55 |
| 8,016,536 | B2 | 9/2011 | Gerber et al. | |
| 8,157,495 | B1 * | 4/2012 | Randall | 414/22.55 |
| 2008/0138174 | A1 | 6/2008 | Hawkins | |
| 2009/0053013 | A1 * | 2/2009 | Maltby | 414/22.61 |
| 2009/0252576 | A1 * | 10/2009 | Gerber et al. | 414/22.54 |
| 2010/0111646 | A1 * | 5/2010 | Smith et al. | 414/22.61 |
| 2010/0135750 | A1 | 6/2010 | Tarique | |
| 2011/0188973 | A1 | 8/2011 | Baumler | |
| 2013/0336747 | A1 | 12/2013 | Hilton | |

* cited by examiner

*Primary Examiner* — Gregory Adams
(74) *Attorney, Agent, or Firm* — Winston & Strawn LLP

(57) ABSTRACT

Equipment for moving tubular members from a storage rack to an elevated platform floor is disclosed. A base-mounted articulated support structure has an arcuate trough mounted on top thereof. Loading arms are secured to a side of the pivotal trough for picking up one tubular member from the rack and moving to the platform floor. Unloading arms detachably securable to the trough facilitate movement of the tubular members from the platform floor onto the rack. A plurality of roller sets mounted between the base and the trough supporting structure move the trough along the base for easy reach to the platform floor.

37 Claims, 23 Drawing Sheets

PIPE HANDLING APPARATUS AND METHOD

CROSS-REFERENCE TO RELATED APPLICATIONS

This application is a continuation-in-part of my co-pending application Ser. No. 13/523,238 Filed on Jun. 14, 2012 entitled "Pipe Handling Apparatus and Method," the full disclosure of which is incorporated by reference herein and priority of which is hereby claimed.

BACKGROUND OF THE INVENTION

This invention relates to oil and gas industry and, more particularly to an apparatus for moving elongated tubular members between a rack and a rig floor.

During drilling and completion operations, it is necessary to make up and/or break down long strings of tubular members such as drill pipe and casing. The string of pipe may be thousands of feet long, and it is therefore necessary to transport pipe joints, which can be up to 32 feet long, from a pipe rack located away from the rig up to the rig floor. When the drill string is tripped out of the hole, the string of pipe is broken down into separate joints and returned to the pipe rack. The drilling platform is usually at some distance from the pipe rack and is elevated above the ground by 15-20 feet.

The handling of oil well pipe is one of the most dangerous jobs on a drilling rig. Some of the pipe joints weigh thousands of pounds, and it is difficult to move the pipe from a horizontal position on the pipe rack into a vertical position overlying the borehole in the rig. The industry has developed various types of equipment to assist in transporting the pipe segments from the pipe rack to the platform and back to the pipe rack. Conventional pipe handling machines use a trailer, a carriage mounted on the trailer and a trough, which is supported by the carriage. The operators load one pipe segment at a time into the trough from the pipe rack. A lift arm moves the carriage to elevate one end of the trough to a platform floor, where rig operators use pick up arms to slide the pipe segment from the trough and lower the pipe segment into the borehole.

Even though part of the pipe handling process is assisted by the elevating carriage, the operators still need to manually lift the pipe segment from a horizontal pipe rack and carefully place it in the trough of the pipe handling machine. It is important to note that the exterior of the pipe segments has a protective anti-corrosive coating, which can be damaged if the pipe segment is dropped or scraped against an edge of the trough. In conventional equipment, the trough is affixed to the elevating arms and does not pivot or tilt.

U.S. Pat. No. 7,665,944 teaches a pipe handling method, which uses a longitudinally extending base frame assembly having a system of base rails or tracks, a movable carriage having a carriage frame and roller assembly for supporting the movable carriage on the frame base rails, and a pipe lifting structure that is mounted to this movable carriage. The carriage, and consequently the pipe lifting structure, is configured so that it may be moved as desired along the length of the base frame by means of the carriage rollers and base rail system to facilitate a desired lifting sequence. The pipe lifting structure has a semicircular pipe support trough that is supported by hydraulically driven telescopically extendable lifting arm assembles. The base end of each telescopically extendable lifting arm assembly is pivotally mounted to the carriage. The trough end of each lifting arm assembly is pivotally mounted to a lifting structure stabilizer frame that extends longitudinally between each lifting arm assembly. According to the '944 patent, the pipe trough is raised by the second end of the first lifting arm; then the lifting arm is extended telescopically without extending the length of the other lifting arm assembly; and then the length of pipe is removed from the pipe trough by pivoting the pipe trough transversely with respect to the base frame.

While the method of U.S. Pat. No. 7,665,944 may work satisfactory in many circumstances, there remains a need for a pipe handling machine that would facilitate movement of the pipe segments from the pipe rack into the trough and further increase safety of the pipe handling process.

The present invention contemplates elimination of drawbacks associated with conventional methods and provision of a pipe handling apparatus and method that assists in moving pipe segments from and to the pipe rack and moving the pipe trough toward the derrick.

SUMMARY OF THE INVENTION

It is, therefore, an object of the present invention to provide an improved pipe handling apparatus and method for use in oil and gas industry.

It is another object of the present invention to provide a pipe handling apparatus and method that facilitates movement of elongated tubular member, such as pipe segments, from a horizontal rack to platform floor and back to the pipe rack.

It is a further object of the invention to facilitate movement of the pipe trough in relation to the base while elevating the pipe trough toward the derrick.

These and other objects of the invention are achieved through a provision of an apparatus and method for moving a tubular member between a storage rack and an elevated floor of a platform. The apparatus has an articulated support structure mounted on a base and slidable movable in relation to the use through a plurality of rollers disposed between the base and the support structure. The support structure has a frame and a plurality of foldable pivotal extendable struts, which carry a semi-cylindrical pivotal trough on top thereof.

Loading arms secured to the trough move to pick up a pipe from the storage rack when the trough is tilted towards the storage rack. When the support structure is elevated it moves along the base, moving the trough with the tubular member towards the platform floor. Unloading arms are detachably securable to the trough as well. The support structure having a tubular member deposited into the trough at the platform floor is lowered and causes pivotal movement of the trough. The unloading arms guide the tubular member from the trough onto the storage rack.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
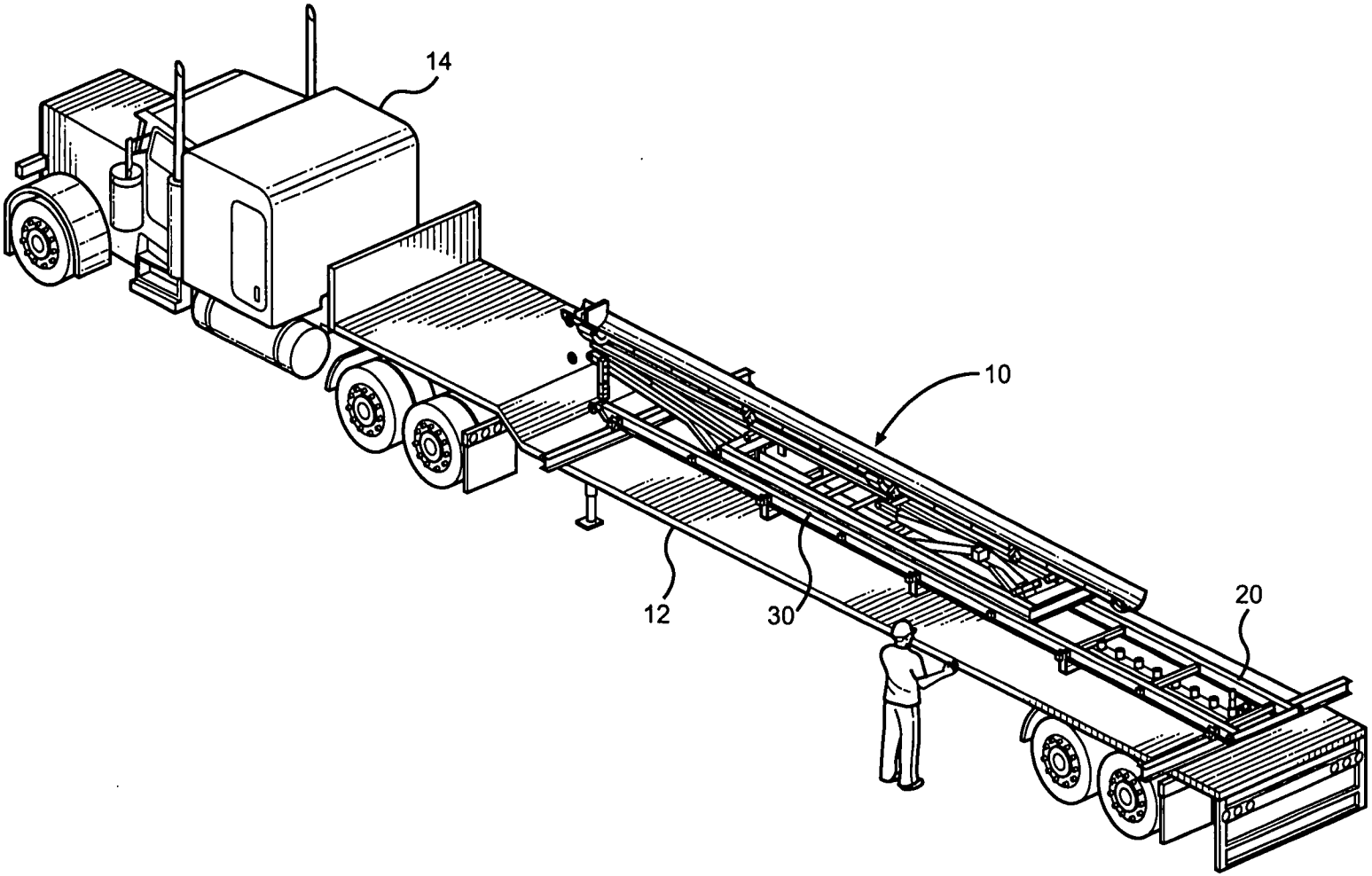
FIG. 1 is a perspective view of the pipe handling apparatus according to the present invention being unloaded from a carrier.

Turning now to the drawings in more detail, numeral 10 designates the pipe handling apparatus according to this invention. The apparatus 10 can be delivered to a work site in any available manner, for instance a trailer 12 illustrated in FIG. 1. The trailer 12 can be attached to a towing vehicle 14 and transported to the designated location, such as a site of a drilling rig 16.

The apparatus 10 comprises a base, such as a skid 20, which supports the apparatus 10 in a longitudinal position during transport. The skid 20 can be formed as an open frame composed of a pair of parallel rails 22, 24 and a plurality of transverse bars 26 extending between the opposing rails 22, 24. The skid 20 can be positioned on the ground adjacent a storage rack 18 and the drilling rig 16 and moved to a preselected position using rotating skid wheels 28 secured to ends of the elongated rails 22, 24. The rails 22 and 24 can be formed as elongated I-beams in cross-section.

Since the skid 20 is located on the bed of a vehicle 14, the vehicle 14 can be maneuvered into place so as to properly align with the centerline of the drilling rig 16. Once the proper alignment is achieved by the vehicle 14, the apparatus 10 can be unloaded to rest on the ground so as to effectively move the tubular between a storage position and the drilling rig 16 and back. The present invention is adaptable to various lengths of tubulars. The tubulars are used in wellbore and derrick operations, such as casing, tubing, drill pipe or stands of pipe that need to be moved from one location to another at the wellbore operations.

Figure 18:
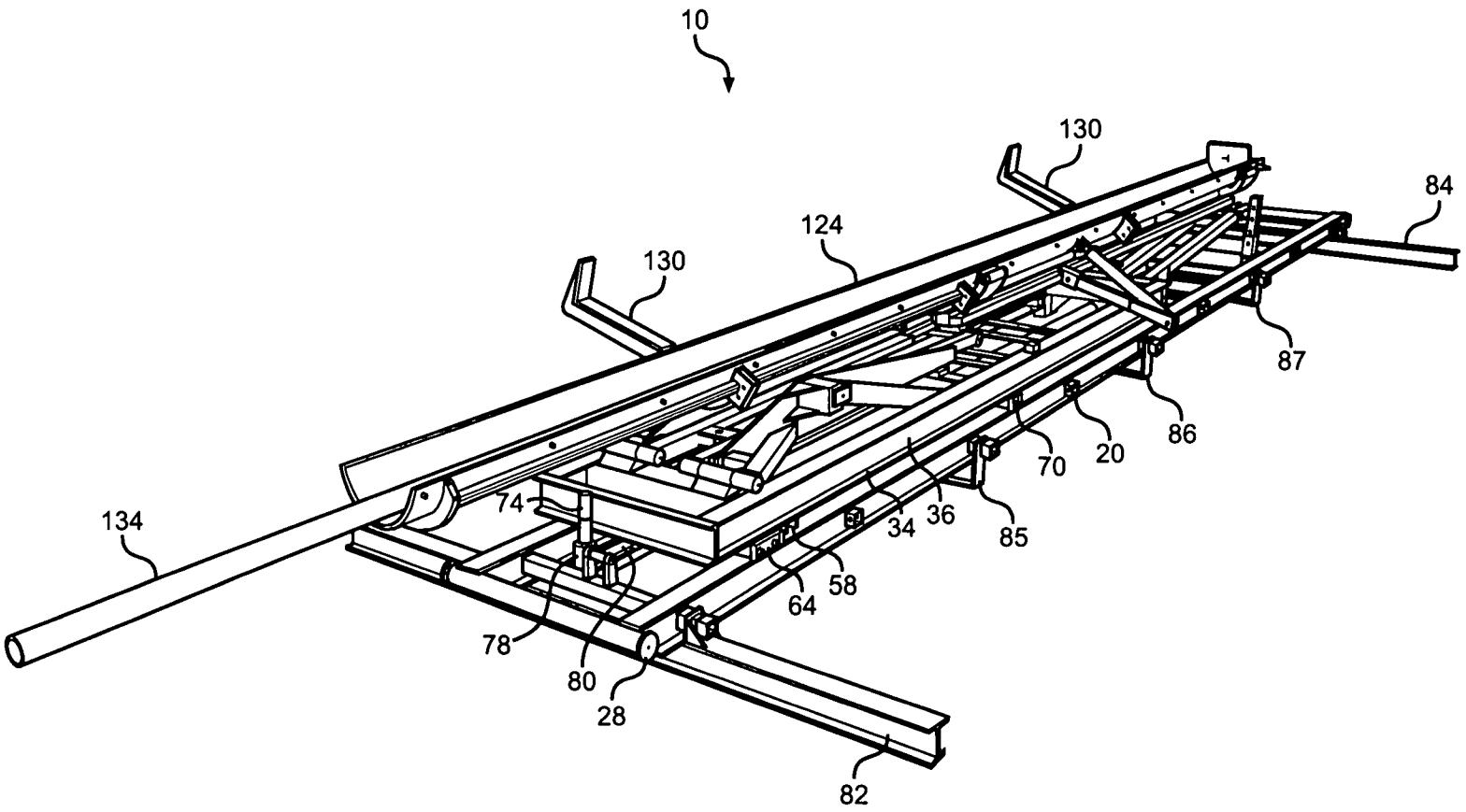
FIG. 18 illustrates is a perspective view illustrates the pipe loader moving assembly in a retracted position, with the pipe loader assembly in a starting position.
Figure 19:
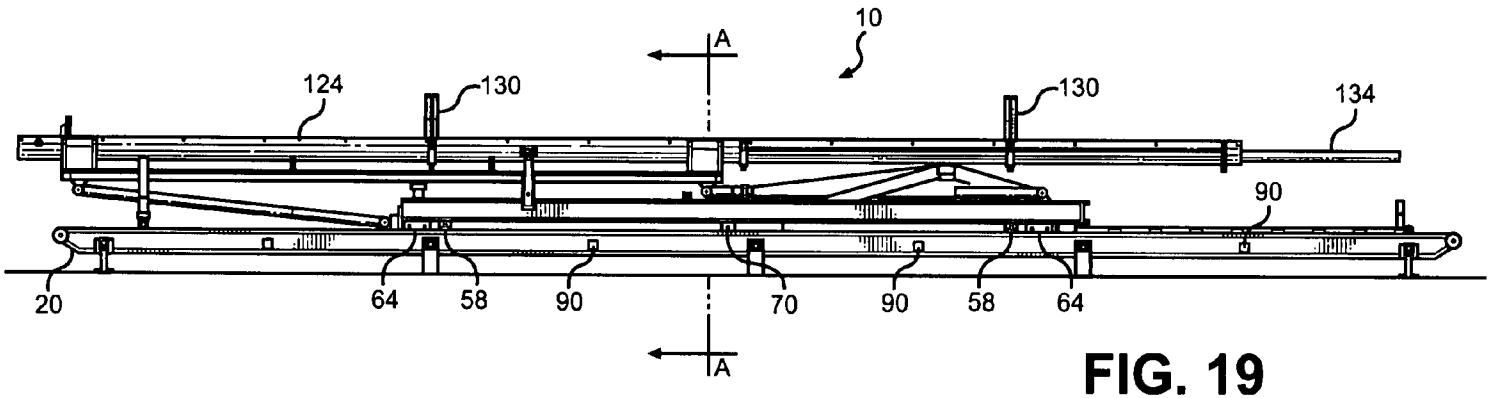
FIG. 19 is a side view illustrating position of roller assemblies.
Figure 20:
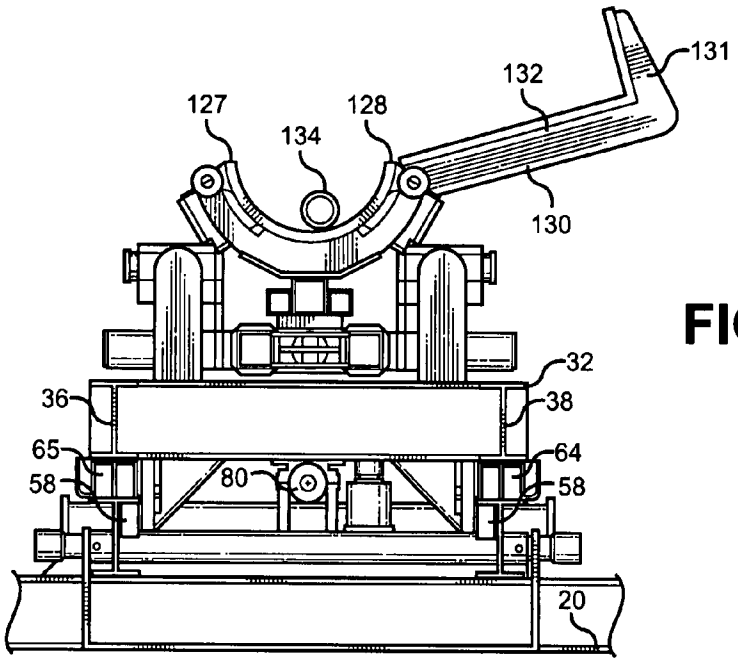
FIG. 20 is a sectional view taken along lines A-A of FIG. 19 and illustrating single roller assemblies in the middle of the pipe loader frame.
Figure 22:
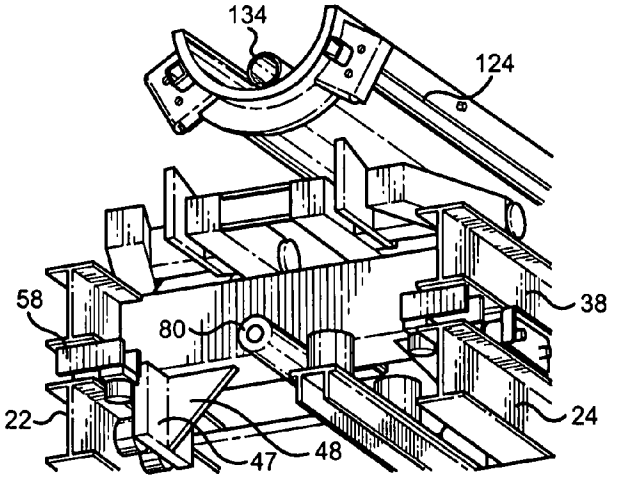
FIG. 22 is a detail perspective view showing side rollers and double roller supporting the pipe loader frame.
Figure 24:
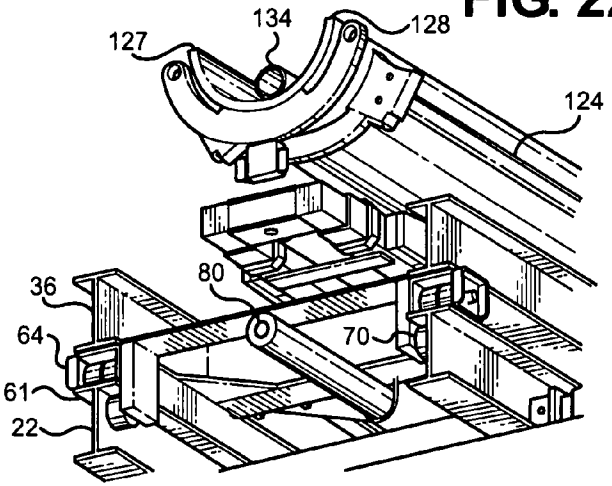
FIG. 24 is a detail perspective view showing single rollers.
Figure 21:
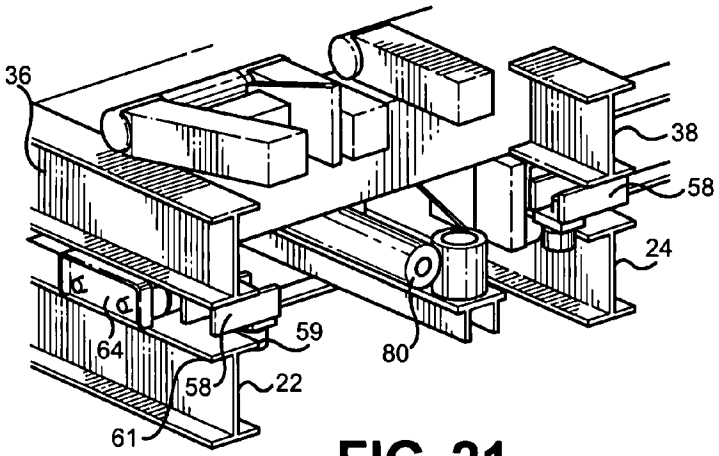
FIG. 21 is a detail perspective side view showing side rollers and double roller supporting the pipe loader frame.
Figure 23:
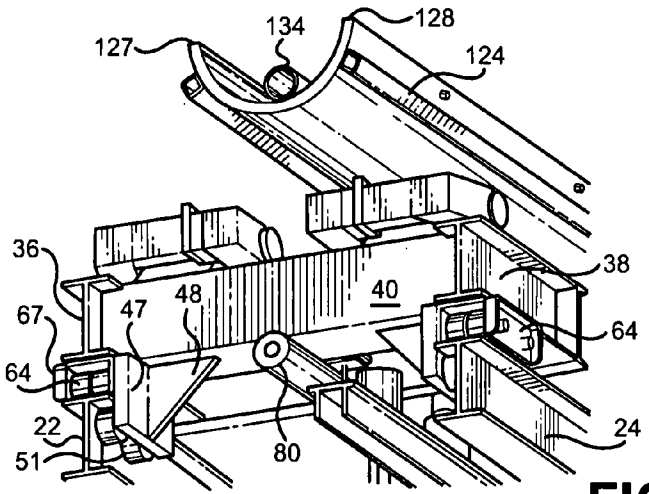
FIG. 23 is a detail perspective view showing double rollers.

The pipe handling apparatus 10 comprises an articulated movable support structure 30, which moves between a folded position shown in FIG. 1 to an extended position shown in FIG. 10 and a plurality of intermediate positions, as will be described in more detail hereinafter. The support structure 30 is comprised of a pipe loader assembly 32, which is disposed to roll on the rails 22 and 24 moving the support structure 30 to and fro between the distant ends 23, 25 (FIG. 18) and proximate ends 27, 29 (FIG. 16) of the rails 22 and 24.

The pipe loader assembly 32 has a substantially rectangular pipe loader frame 34 having side frame members 36, 38 and cross frame members. The drawings illustrate only the distant cross frame member 40 and it will be understood that a mirror image proximate transverse frame member is secured between proximate ends of the side frame members 36, 38.

A plurality of roller assemblies is affixed to the bottom of the side frame members 36, 38. The rollers are disposed to roll on the rails 22, 24 of the skid 20, moving the pipe loader assembly toward and away from the derrick 16. The roller assemblies include matching sets of undercarriage roller assemblies 46 secured adjacent the distant frame member 40, one on each side of the pipe loader frame 32.

As can be seen in FIGS. 21-24 and 31-32, the undercarriage roller assembly 46 comprises a plate 47 and a bracket 48, both of which are welded to a cross beam 49 of the pipe loader frame 32. Each of the undercarriage roller assemblies 46 comprises a pair of aligned rollers 50, 51 disposed for rotation about parallel central axes created by the roller pins 52, 53, respectively. The axes of rotation of the rollers 50, 51 extend transversely to a longitudinal axis of the skid 20 and the pipe loader frame 32. The rollers 50, 51 are disposed to contact an underside surface 54 of an upper cross plate 61 of the rails 22, 24.

Figure 31:
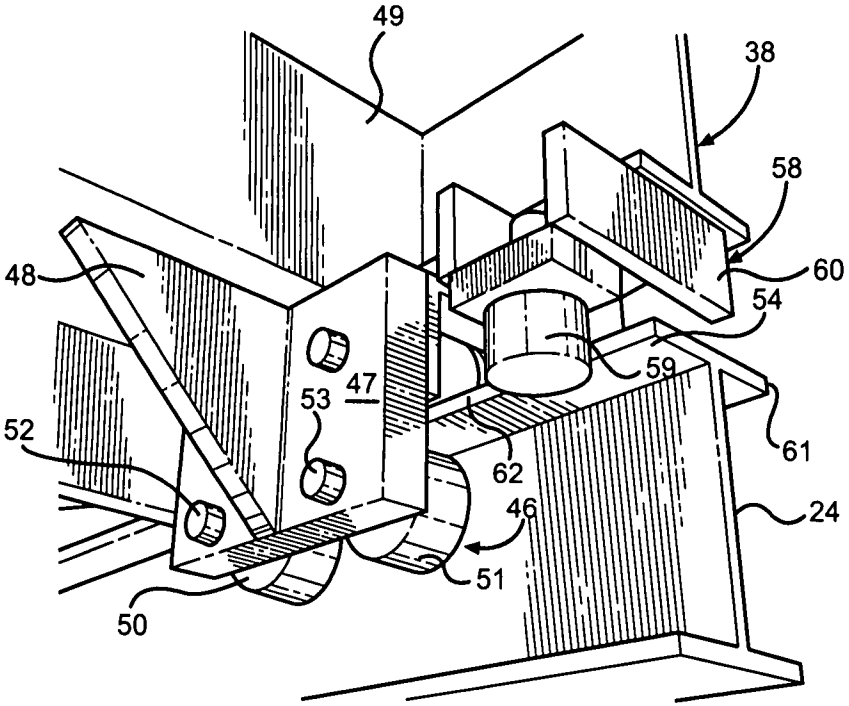
FIG. 31 is a detail perspective view illustrating roller sets secured to the pipe loader frame.

A second set of rollers is formed by a side roller assembly 58 (FIG. 31). The side roller assembly 58 comprises a single roller wheel 59 suspended from a side roller frame 60. The side roller 59 is disposed to contact a longitudinal edge 62 of the upper cross plate 61 of the rails 22, 24. The axis of rotation of the side roller 59 is transverse to the longitudinal axis of the rails 22, 24 and the axes of rotation of the underside rollers 50, 51.

A third set of rollers is formed by a double roller assembly 64 which is disposed between the skid 20 and the pipe loader frame 32. The apparatus 10 provides for four such double roller assemblies 64, one on each end of the pipe loader frame 32. The double roller assembly 64 comprises a pair of rollers 65, 66 secured to roll side-by-side on top of the upper cross plate 61 of the rails 22 and 24. The double rollers 65, 66 are supported by a frame 67, which is secured to the underside of the pipe loader frame 32. The axis of rotation of the rollers 65, 66 is parallel to the axis of rotation of the undercarriage rollers 50, 51 and transverse to the axis of rotation of the side rollers 59 and longitudinal axis of the pipe loader frame 32.

A fourth set of middle rollers 70 is positioned in the center of the pipe loader frame 32, one on each of the side frame members 36, 38. The middle rollers 70, similarly to the undercarriage rollers 50, 51 engage the underside of the cross plate 61 and rotates about an axis parallel to the undercarriage roller 50, 51.

The roller sets 46, 58, 64 and 70 stabilize position of the pipe loader assembly on the skid 20 and ensure smooth aligned guided movement of the pipe loader support assembly 30 in relation to the skid 20.

Figure 16:
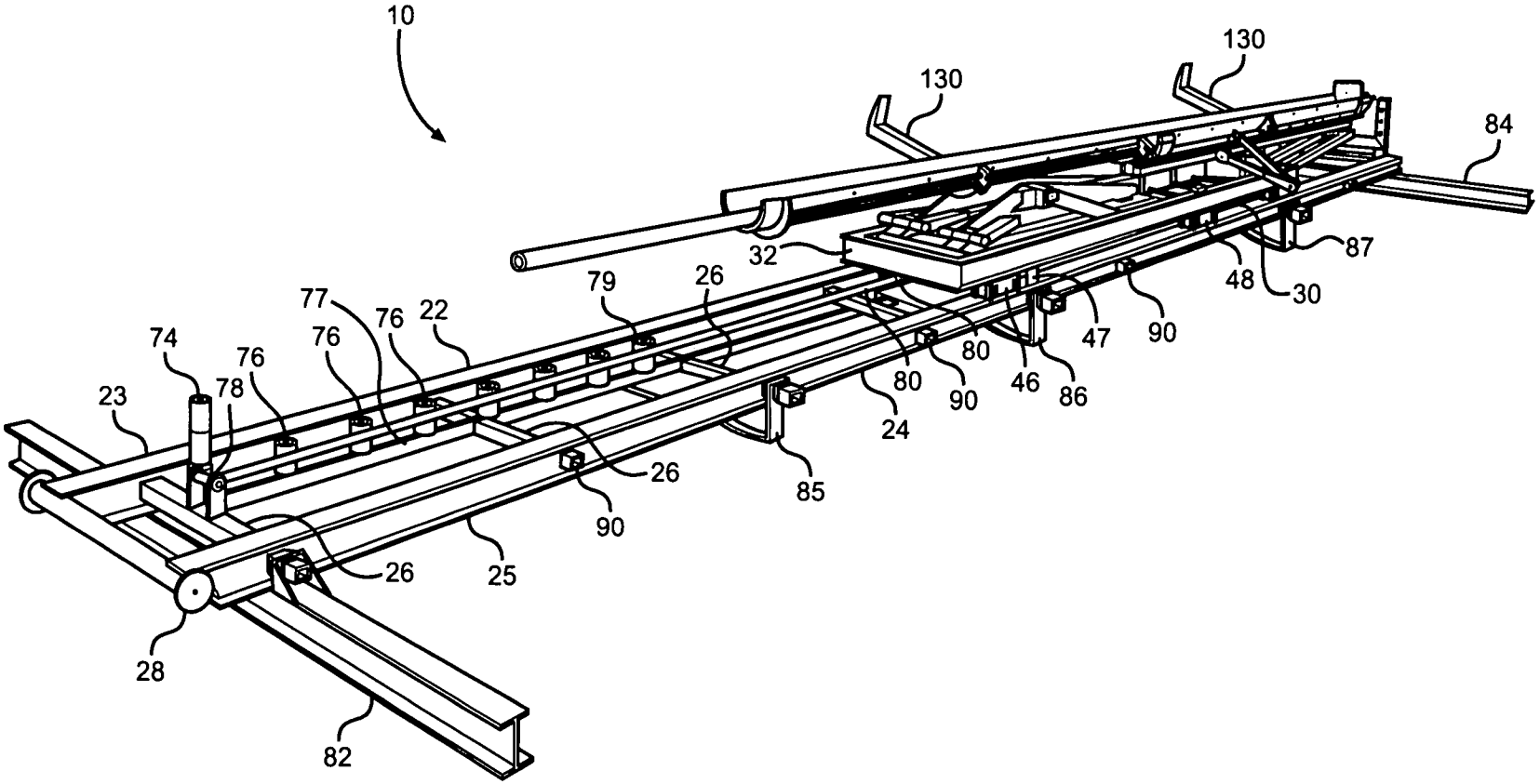
FIG. 16 is a perspective view movement of the pipe loader assembly along the base, with the pipe trough in a horizontal position.
Figure 17:
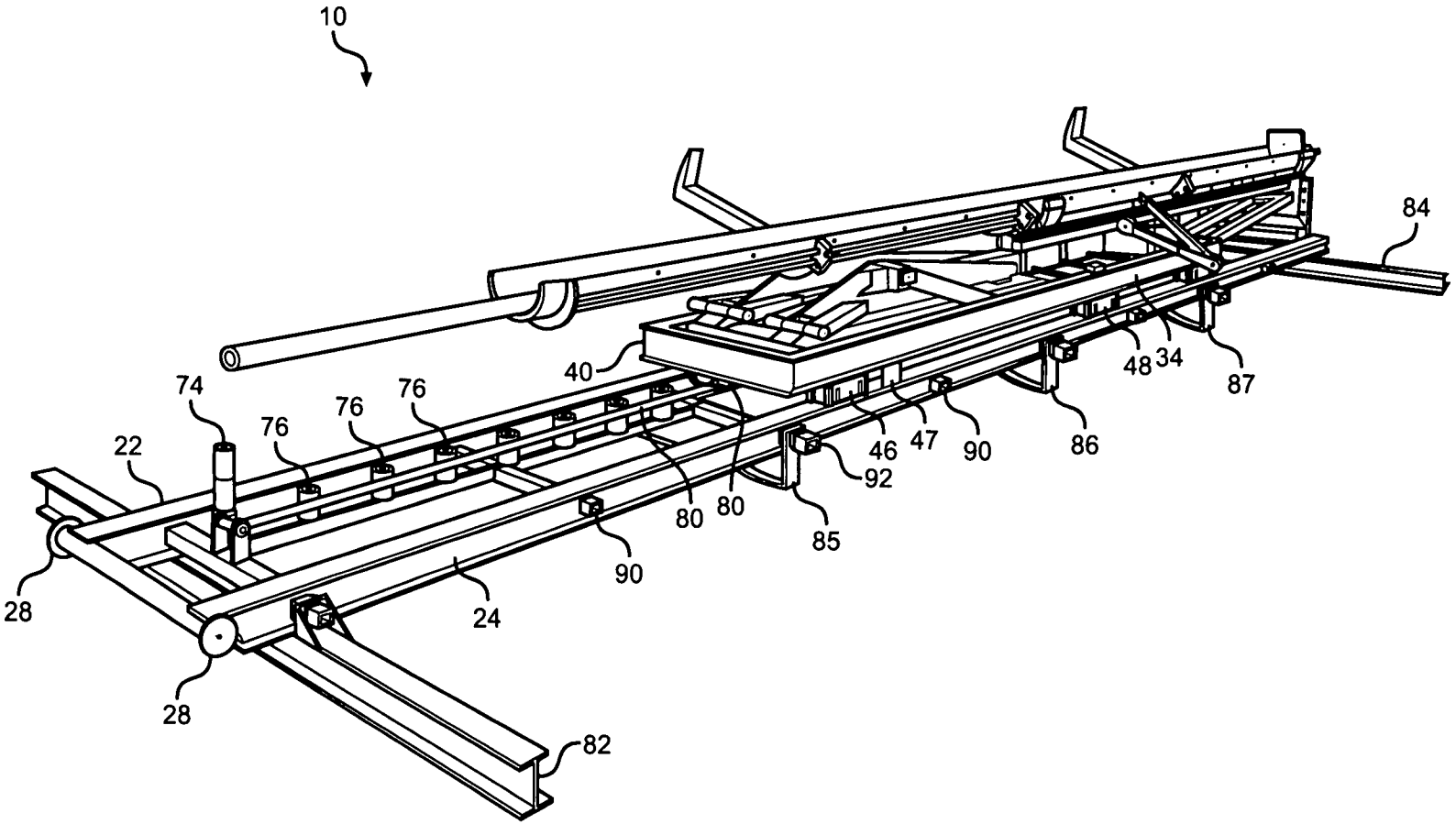
FIG. 17 is a perspective view illustrates the pipe loader moving assembly in a retracted position, with the pipe loader assembly being moved forward.

The pipe loader assembly 32 has a limited lateral movement along the rails 22, 24 of the skid 20. A safety stop bar 74 limits the longitudinal travel of the pipe loader frame 32 in relation to the skid 20. The safety stop bar 74 is removably engaged in one of the sleeves 76, which are attached to an elongated plate 77 secured between transverse bars 26, as shown in FIG. 16. The most distant point of travel of the support structure 30 along the base 20 is defined by a distant sleeve 78, while the forwardmost limit of the support structure 30 travel along the base 20 is defined by a proximate sleeve 79. The safety stop bar 74 is selectively detachably engaged with any of the sleeves 76, 78, or 79 as the support structure 30 moves in relation to the skid 20 toward the derrick 16. A power source, such as for instance a hydraulic cylinder 80 secured to the undercarriage of the support assembly 30 causes movement of the support assembly 30 in relation to the skid 20. The stops for the movement of the support structure 30 are determined based on the length of the pipe being moved and the positioning of the entire unit, for instance the spotting of the unit as compared do the rig deck 17.

The hydraulic cylinder 80 hydraulic cylinder has a bypass valve (not shown) such that if the operator hits the stop that the hydraulic system is designed to stop pushing against the stop bar 74 and reflect the hydraulic pressure back to the reservoir. As the operator becomes familiar with the stroke of the entire carriage it is envisioned that the need to the stop command will become a rare occurrence. In any event, a relief valve is provided to bypass the pressure so as not to damage the equipment.

Figure 11:
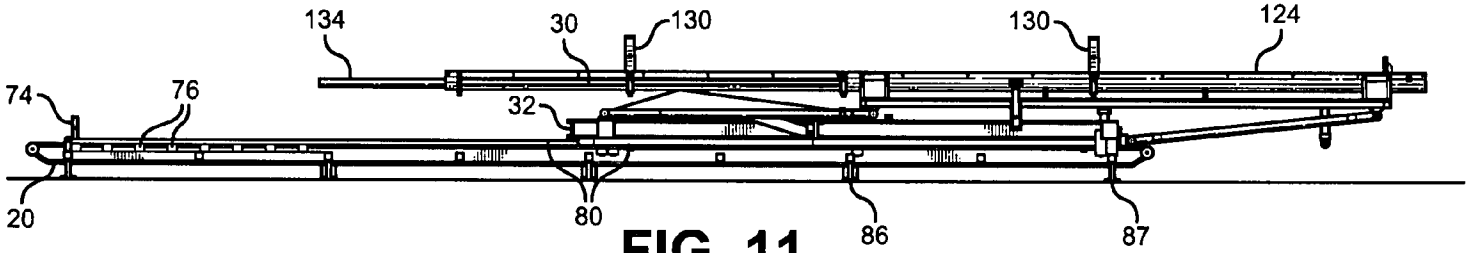
FIG. 11 is a side view illustrating moving of the pipe loader assembly along the base.
Figure 12:
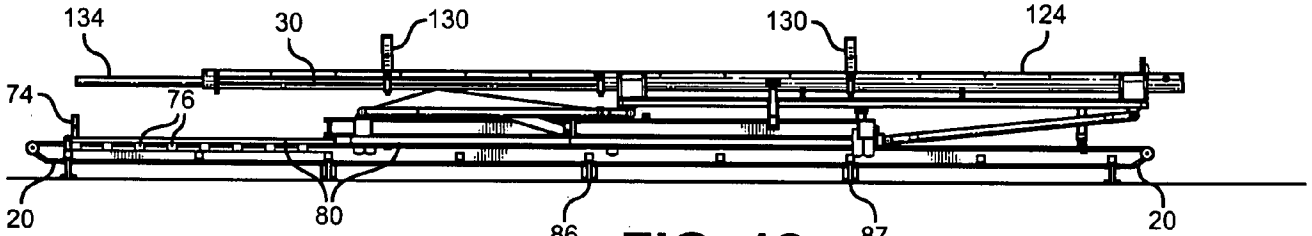
FIG. 12 is a side view illustrating retraction of the pipe loader moving assembly and the pipe loader assembly moving forward on rollers.
Figure 13:
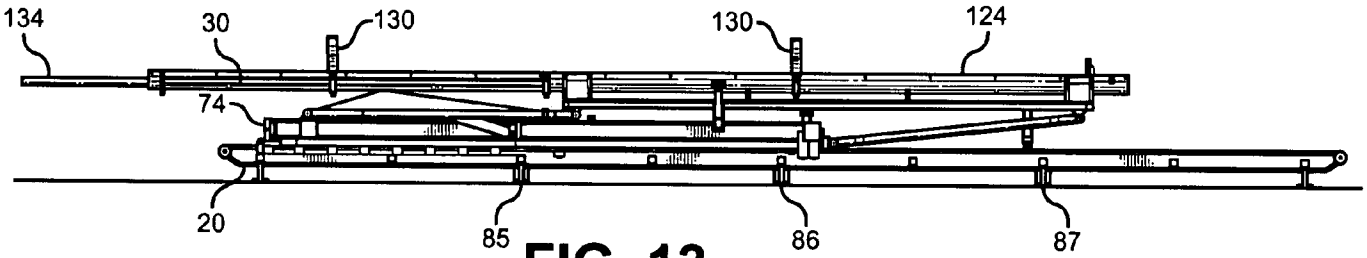
FIG. 13 is a side view illustrating the pipe loader assembly returning to a starting position.

As shown in FIG. 11, the hydraulic cylinder 80 extends the support assembly 30 along the skid 20 forwardly from the starting position. When the hydraulic cylinder 80 retracts, as shown in FIG. 12, the support assembly 30 rolls back along the skid 20. When the hydraulic cylinder is fully retracted, as shown in FIG. 13, the frame 30 returns to its starting position contacting the stop bar 74. In this position the stop bar 74 prevents further movement of the support assembly 30 along the skid 20.

The skid 20 is disposed to rest on leg assemblies that are configured to be positioned on the ground and be adjustable depending on the contours of the site terrain. Distant ends 23, 25 of the rails 22 and 24, respectively, rest on a transverse distant beam 82, which can be formed as an I-beam in cross-section. Proximate ends 27, 29 of the rails 22, 24, respectively, are supported by a forward transverse beam 84, which can be similarly formed as an I-beam in cross-section. Additionally, a plurality of balance legs 85, 86, and 87 are secured to the sides of the rails and extend downwardly therefrom. Each of the balance legs 85, 86, and 87 is formed as a U-shaped member with the bottom portion disposed to rest on the ground while supporting the rails 22 and 24.

FIGS. 33-39 illustrate positioning of the supporting legs assemblies on the skid 20. A plurality of laterally spaced-apart leg engagement members 90 is secured to the vertical walls of the rails 22 and 24. Each leg engaging member 90 comprises a piece of hollow tubing, which can be rectangular or square in cross section to provide a no-twist engagement with a connection plug 92. The connection plug 92 has a matching configuration to frictionally engage within the leg engaging member 90. An enlarged outer part 93 of the connection plug 92 prevents extension of the connection plug 92 too far through the leg engaging member 90.

Figure 36:
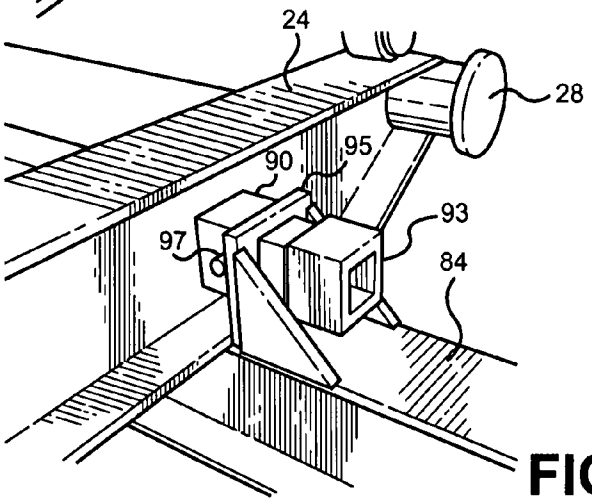
FIG. 36 is a detail perspective view of the transverse beam engaged with the connection plug.
Figure 35:
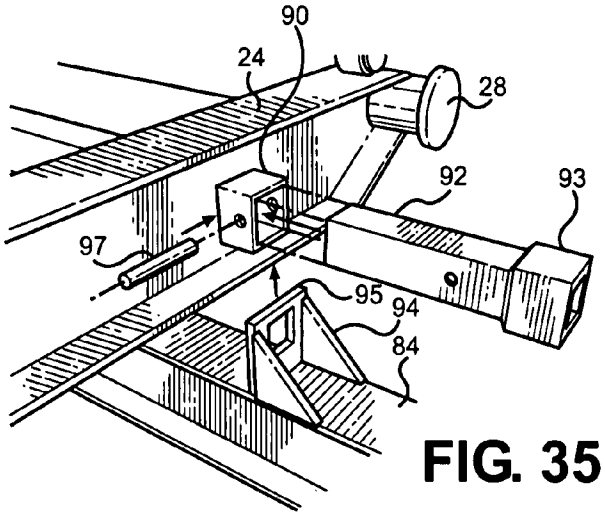
FIG. 35 is a detail exploded view showing a movable transverse beam and a connection plug.
Figure 37:
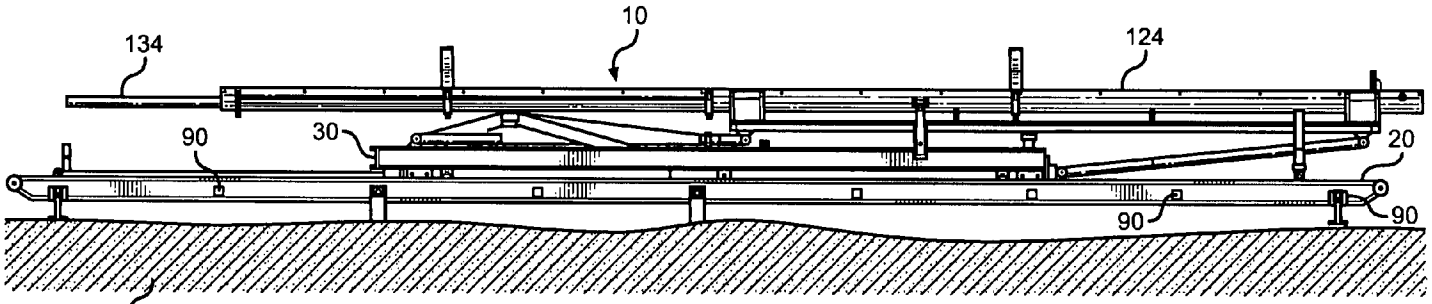
FIG. 37 is a side elevation of the apparatus of the present invention positioned on an uneven ground and supported by selective transverse beams and middle balance legs.

The distant transverse beam 82 and the proximate transverse beam 84 are each provided with a bracket 94, which has a vertical member 95 secured to an upper surface of the transverse beam 82 and 84. An opening 96 is formed in the vertical member 95. The connection plug 92 passes through the opening 96 of the bracket 94 and into the leg receiving member 90. A pin 97 fits through aligned openings formed in the walls of the leg engaging member 90 and the plug 92 securing the transverse beam 82 and 84 with the rails 22, 24, as shown in FIGS. 35 and 36. The transverse beams 82, 84 can be engaged with the outermost leg engaging members 90, as shown in FIG. 37 or moved closer to the center of the skid 20, as shown in FIGS. 38 and 39.

Figure 34:
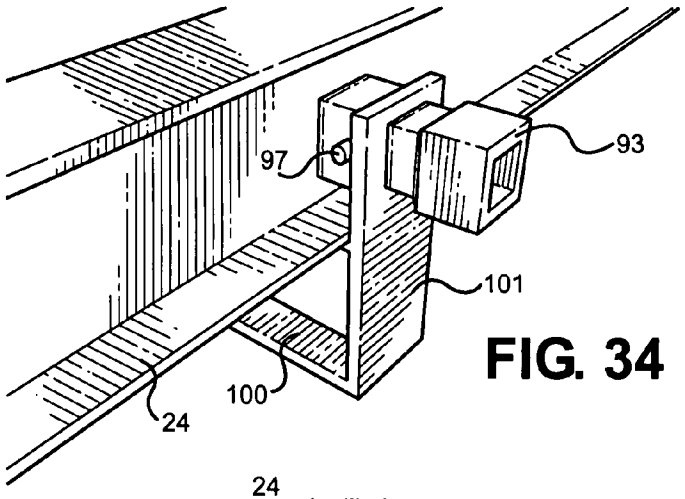
FIG. 34 is a detail perspective view of the middle balance leg engaged with the pipe loader base frame.
Figure 33:
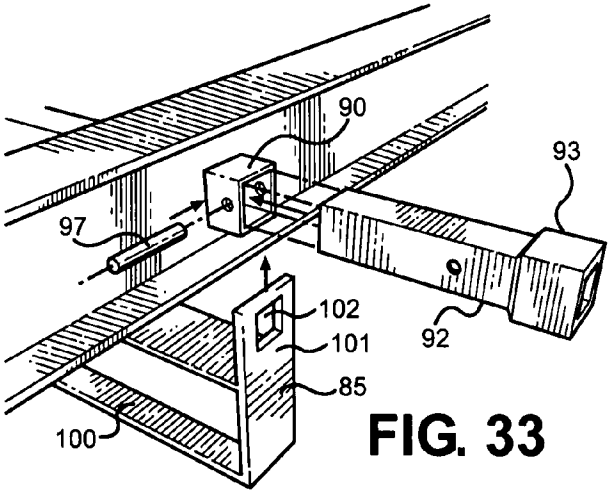
FIG. 33 is a detail exploded view showing a middle balance leg with a connection plug.

FIG. 33 illustrates a balance leg assembly 85, which comprises a U-shaped leg having a horizontal portion 100 and a pair of vertically extending portions 101. It will be understood that the leg assemblies 86 and 87 have a similar structure. The length of the horizontal portion 100 is sufficient to span between the rails 22 and 24 and allow the vertical portions 101 to extend upwardly outside of the rails 22, 24. The Vertical portions 101 are each provided with an opening 102, which similar to the opening 96, allows the connection plug 92 to extend therethrough. The pin 97 engages aligned openings formed in the leg engaging member 90 and the connection plug 92 once the connection plug 92 is positioned within the leg engaging member 90, as shown in FIG. 34.

Figure 38:
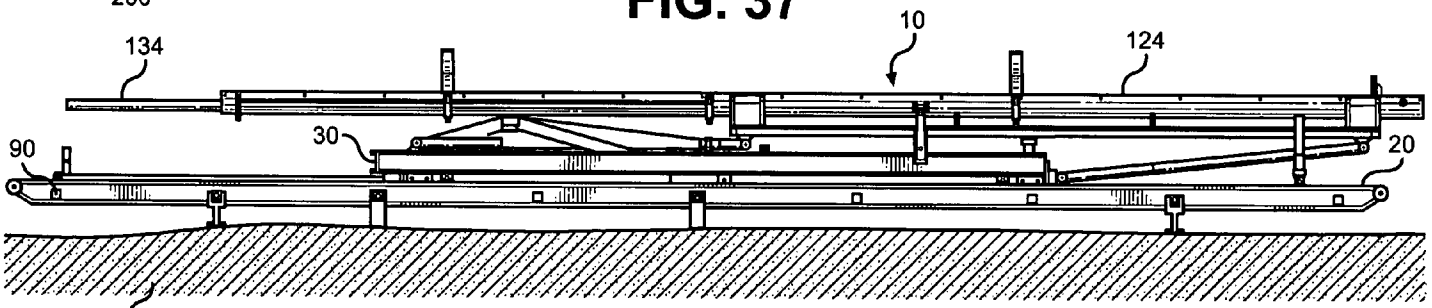
FIG. 38 is a side elevation of the apparatus of the present invention positioned on an uneven ground and supported by selective transverse beams and middle balance legs moved to a different position along the length of the skid.
Figure 39:
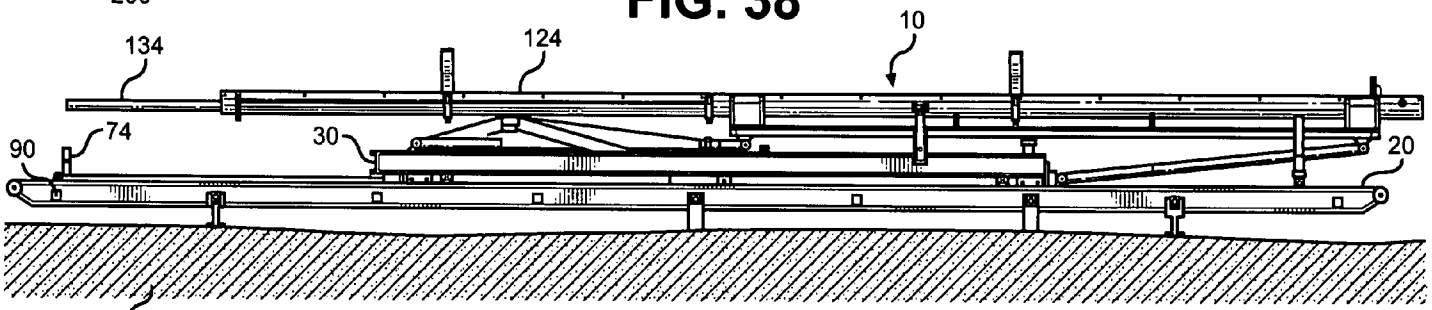
FIG. 39 is a side elevation of the apparatus of the present invention positioned on an uneven ground and supported by selective transverse beams and middle balance legs moved to different positions relative to the skid.

FIGS. 38 and 39 illustrate different positions of the leg assemblies 85, 86, and 87 relative to the rails 22, 24. The moveable leg assemblies 85, 86, 87 allow adjustment of the lateral position of the apparatus 10 relative to the ground 200. Two or more leg assemblies 75 can be used for supporting the apparatus 10 by moving the leg assemblies to engage with any of the spaced leg engaging members 90.

Figure 9:
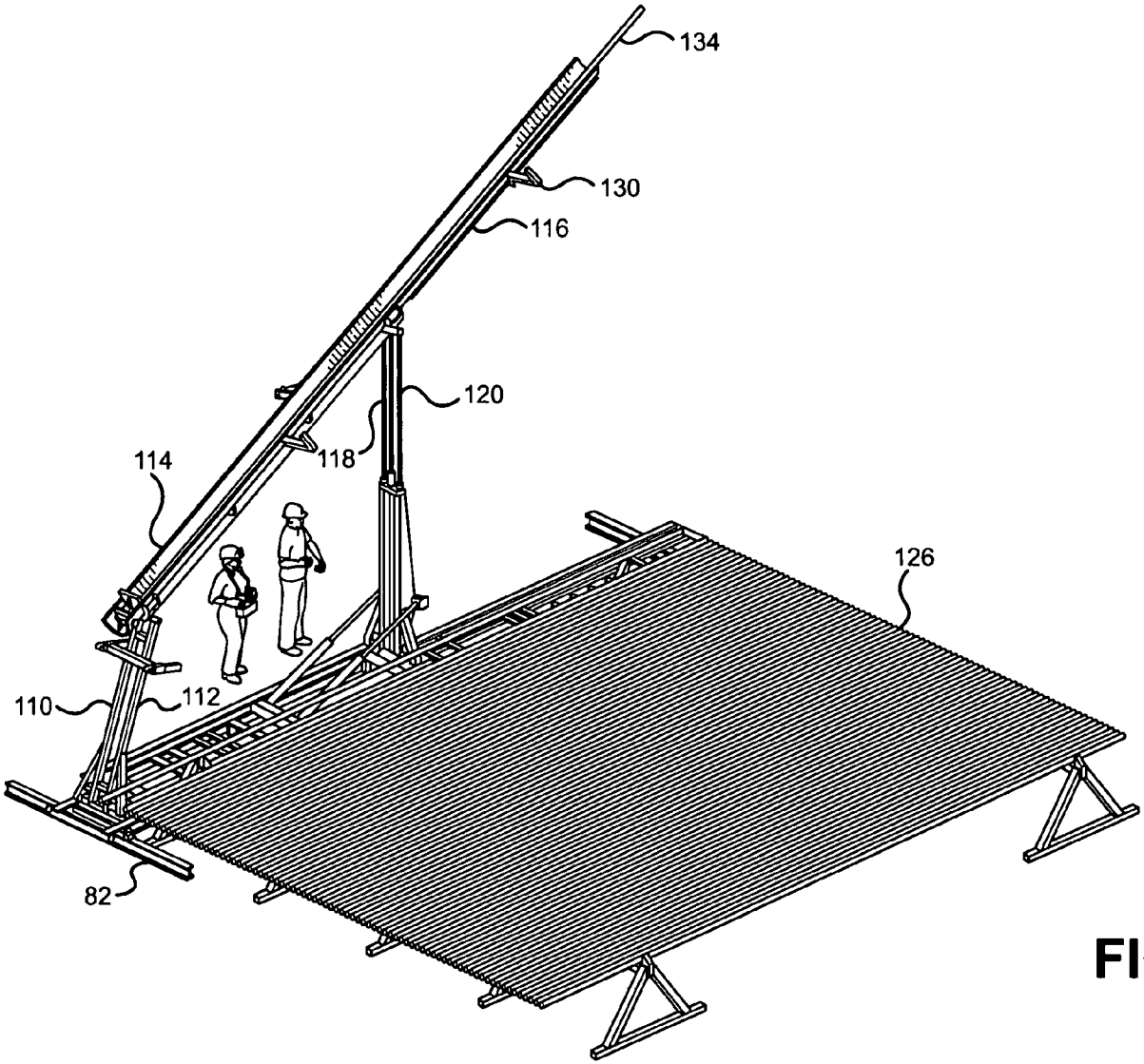
FIG. 9 illustrates the pipe handling apparatus with the elevated pipe trough in an inclined position.
Figure 10:
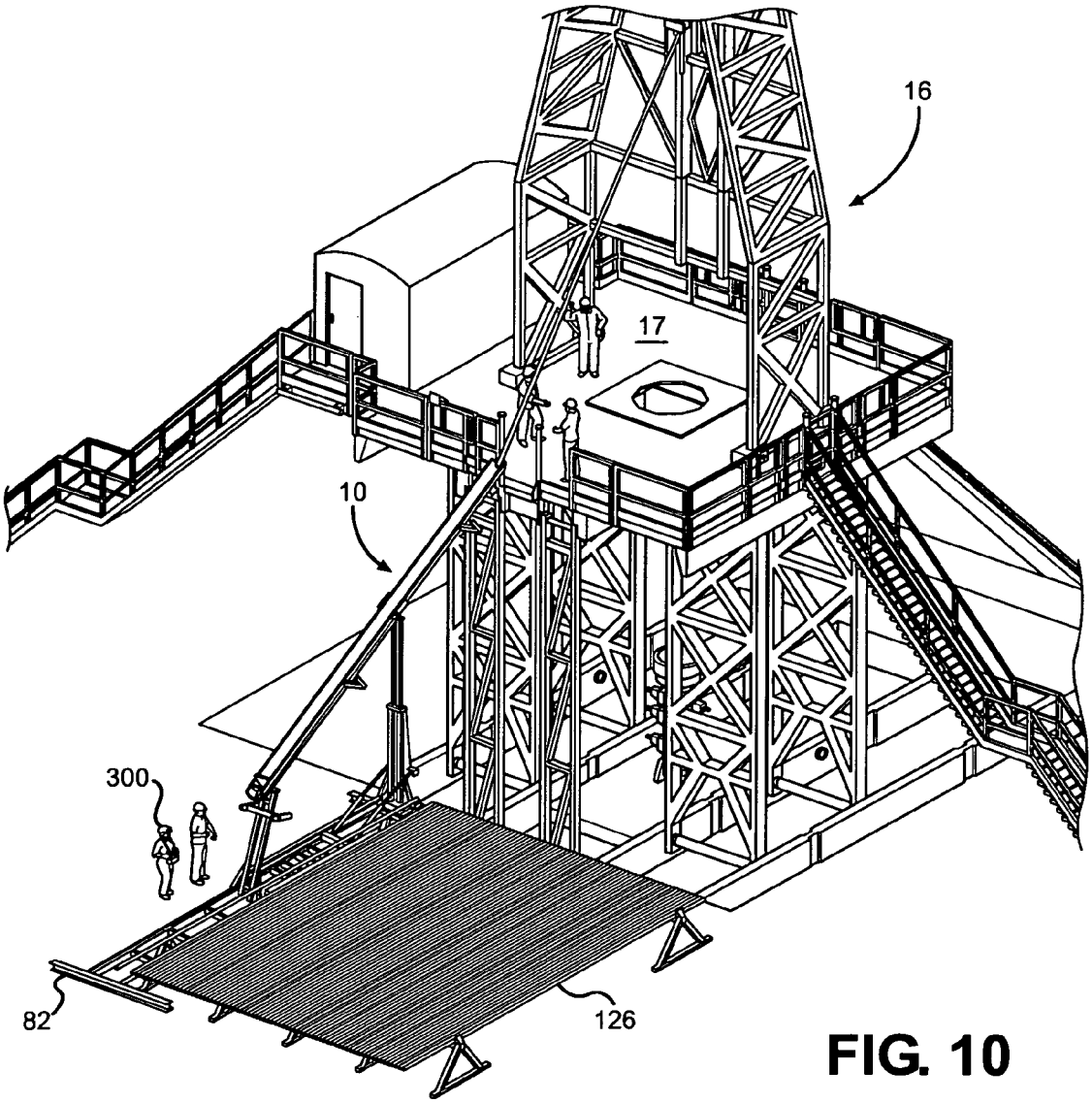
FIG. 10 illustrates the pipe handling apparatus reaching to a platform floor, with the pipe loader assembly rolling forward on the base.

The apparatus 10 comprises a system of hydraulically movable struts or cylinders, which move the pipe loader assembly between a folded position of FIG. 1 and a fully extended position shown in FIG. 10 for transporting tubulars between a storage rack and the derrick. The extendable foldable pivotally movable struts are secured to the pipe loader support assembly 30 and comprise a first pair of struts 110, 112, which are disposed to support a distant end 114 of a pipe trough 116. A second pair of struts 118, 120 is laterally spaced from the first pair of struts, as shown for instance in FIG. 9. Each of the struts 42-45 comprises telescopically extendable rods that can be extended and retracted hydraulically, or using other suitable power source, in relation to their respective pistons.

The struts 110, 112, 118, and 120 support an elongated arcuate trough 124, which can be formed as a semicylindrical body having longitudinal dimensions approximating longitudinal dimensions of tubulars to be handled by the apparatus 10. In one aspect of the invention, a longitudinal axis of the trough 124 extends substantially parallel to a longitudinal axis of the support assembly 30 when the trough 124 is in a storage position shown in FIG. 1. The trough 124 is disposed to move a pipe from the storage rack 126 to the derrick 16 using the sliding movement of the pipe loader support assembly 30 along the skid 20.

The trough 124 comprises parallel side edges 127, 128 extending along the length of the semicylindrical body. Two or more spaced-apart loading arms 130 are secured to the trough 124 adjacent the edge 128. For convenience, the edge 128 will be considered the right edge of the trough 124 when seen in the detail side views of FIGS. 3-5. Of course, depending on the location of the storage rack 126 of the tubulars 134, the loading arms 130 can be secured adjacent the left edge 127. The loading arms 130 have a generally L-shaped configuration with a first shorter part 131 and a second longer part 132.

Figure 4:
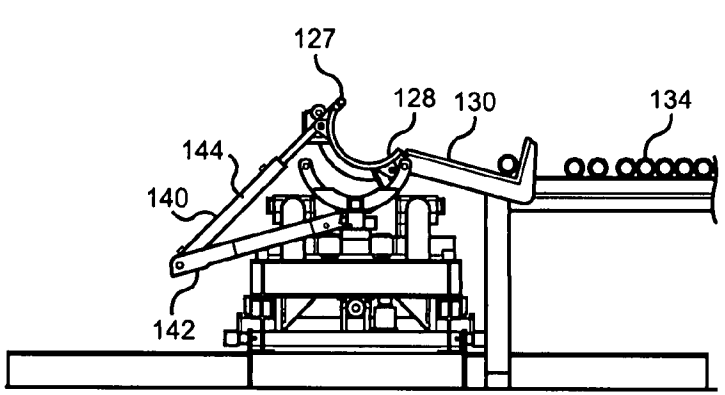
FIG. 4 is a detail side view illustrating the loading arm positioned for engaging a tubular member.
Figure 3:
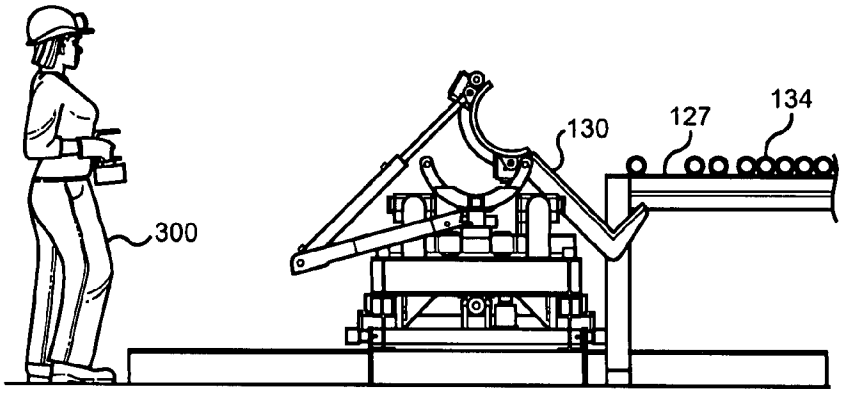
FIG. 3 is a detail side view illustrating a loading arm secured to one side of the pipe trough in a starting position.
Figure 5:
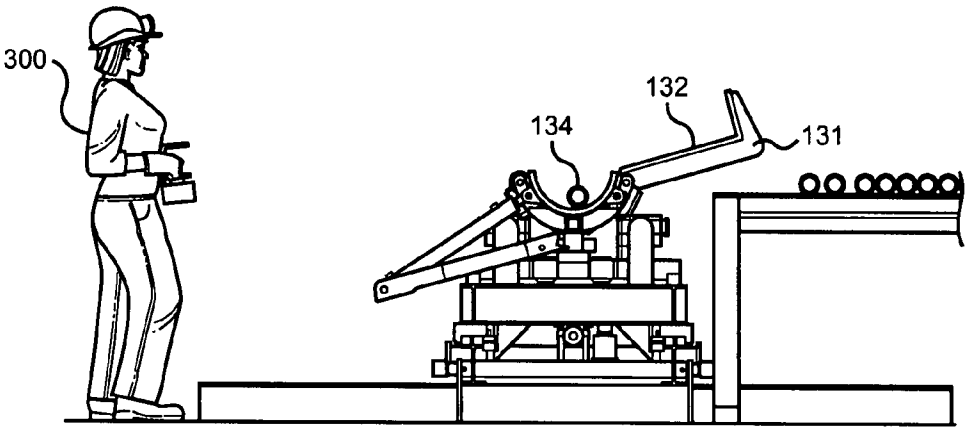
FIG. 5 is a detail side view illustrating the loading arm pivoted to guide the pipe segment into the pipe trough.

The trough 124 can tilt in relation to the pipe loader assembly 32 between a storage position shown in FIG. 5 and loading positions shown in FIGS. 3 and 4. Articulated pivot assemblies 140 move the trough 124 between loading and unloading positions. The articulated pivot assemblies 140 comprise a first elongated bar 142 coupled to the underside of the trough 124 and telescopically extendable second bar 144 pivotally connected to a free end of the first bar 142. The second bar 144 can be hydraulically operated.

During a loading operation, the apparatus 10 is positioned adjacent the storage rack 126, which stores a plurality of tubular members or tubulars 134 in a horizontal position. An operator 300 activates the power source, such as a hydraulic motor (not shown) to move the trough 124 in general vertical alignment with the storage rack 126. Another worker may assist in urging the tubular member towards an edge of the rack 126.

Figure 2:
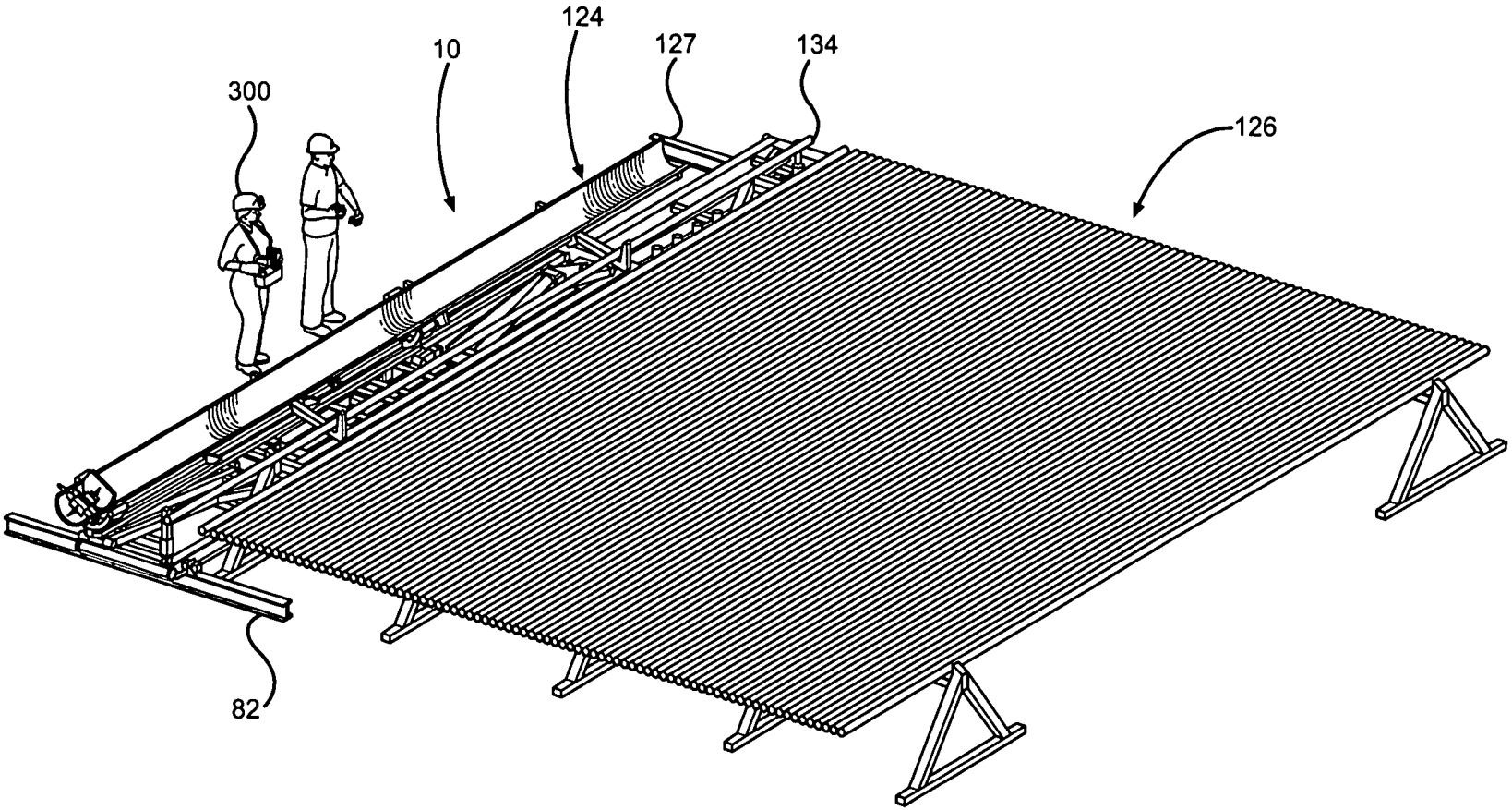
FIG. 2 illustrates position of the pipe handling apparatus adjacent an elevated storage rack, with the loading arms ready to pick up a tubular member.
Figure 6:
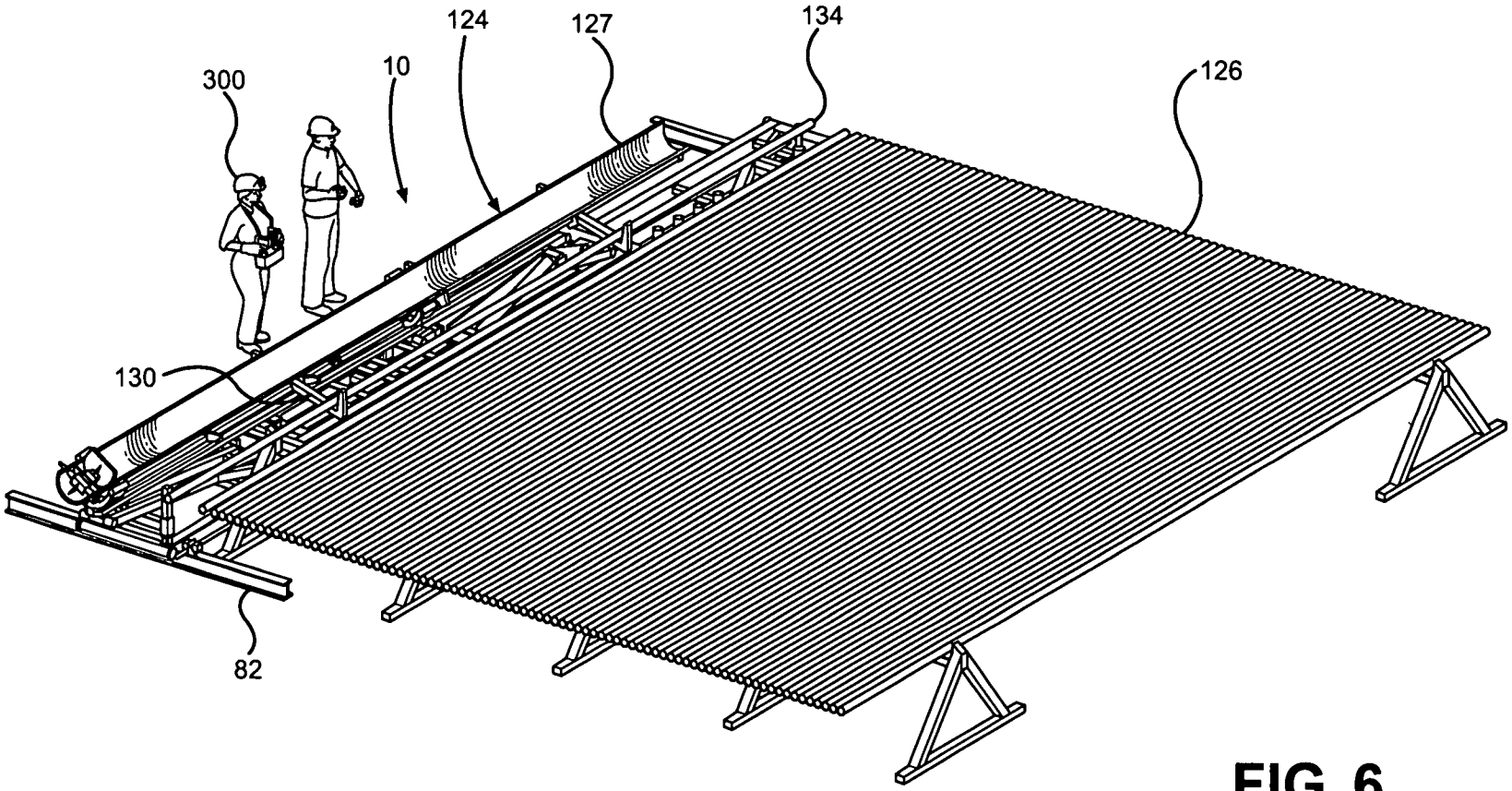
FIG. 6 illustrates the trough being rotated while picking up the tubular member.

The operator 300 then causes the trough 124 to pivot ninety degrees as shown in FIGS. 2 and 3*from* a stationary position shown in FIG. 1. The loading arms 130 move below the surface 127 of the storage rack 126, on which the tubulars 134 are positioned. First, the trough 124 is tilted at 90 degrees, as shown in FIG. 3, and the loading arms 130 pick up the forwardmost tubular segment 134. The trough 124 is then rotated back 45 degrees to a position shown in FIGS. 4 and 6 allowing the pipe 134 to slide along the longer portion 132 of the loading arms 130 and into the cradle formed by the arcuate surface of the trough 124.

Figure 7:
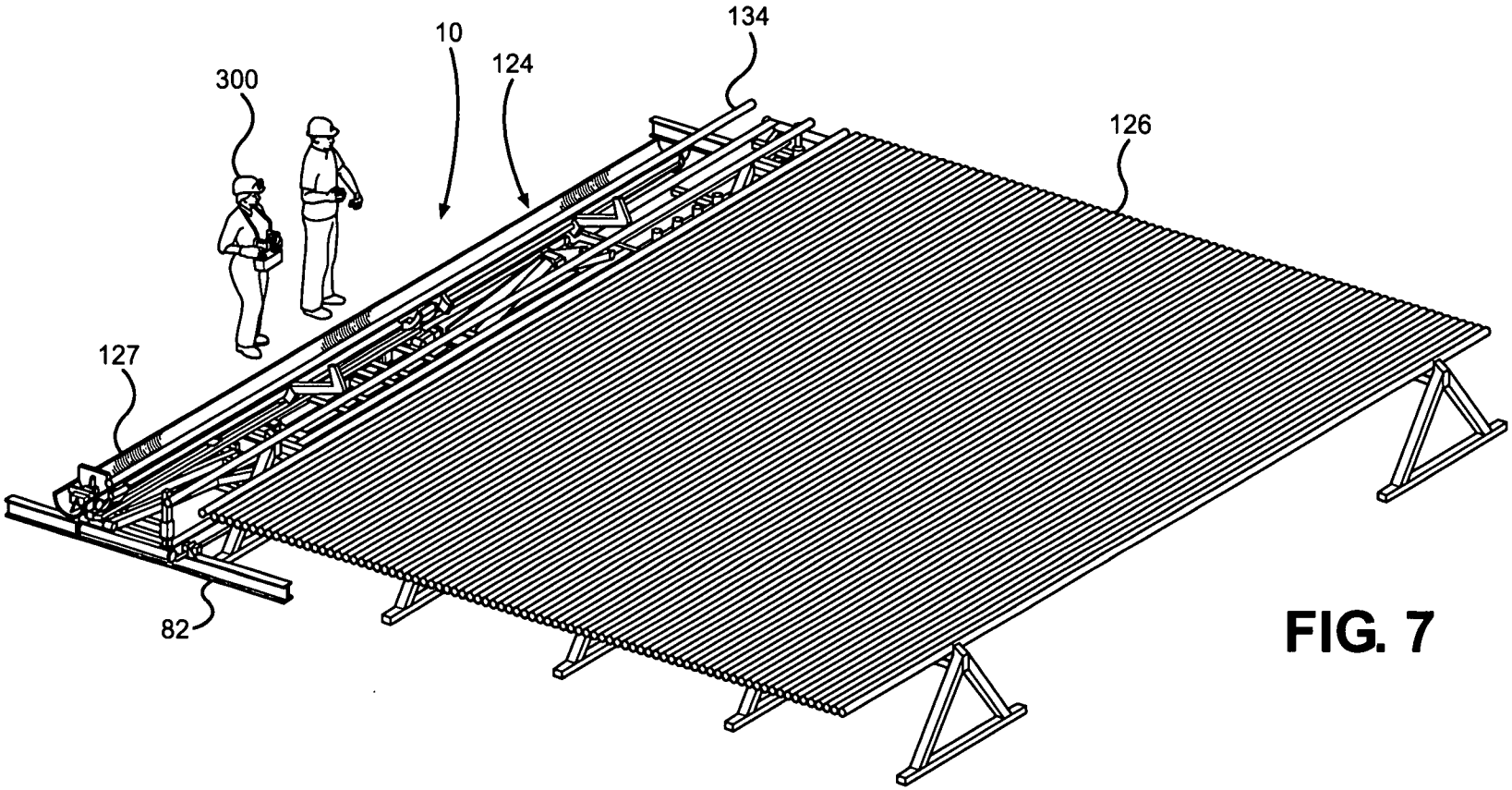
FIG. 7 illustrates the pipe handling apparatus with the pipe trough in a position ready to be elevated.

Since the second part 132 of the loading arm 130 is oriented at an obtuse angle in relation to the edge 128 and extends somewhat upwardly from the edge 128, the tubular 134 rolls along the second part 132 of the loading arm 130 into the trough 124. The pipe 134 will then be in a position shown in FIGS. 5 and 7, inside the trough 124, having rolled into the trough 124 by gravity. If desired, the contact surfaces of the loading arms 130 can be coated with non-abrasive coating so as not to damage exterior of the tubular 134. As the trough 130 returns to the starting position illustrated in FIGS. 5 and 7 the tubular member 134 remains in the trough.

Figure 8:
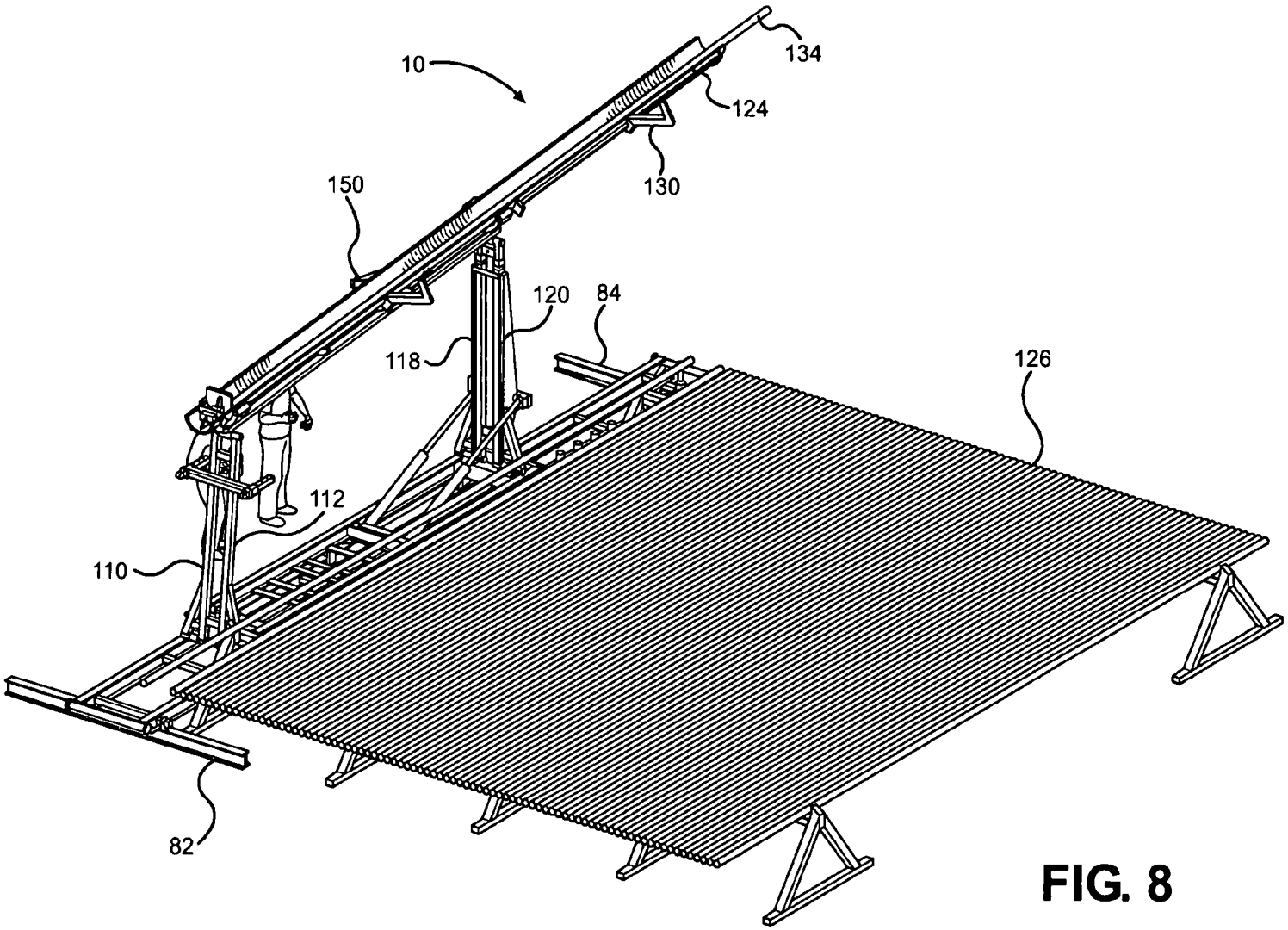
FIG. 8 illustrates the pipe handling apparatus with an elevated trough, with rear legs rotated and front legs rotated 90 degrees.

Referring now to FIGS. 8-10, the process of delivering the tubular strand 134 to the rig floor will be explained. Starting from the stationary position shown in FIG. 7, the operator activates the struts 110, 112 causing them to be gradually elevated to extend at about 90 degree angle in relation to the skid 20. The front struts 118, 120 are then gradually telescopically extended upright thereby positioning the pipe 134 at an angle in relation to the base 20, as shown in FIG. 9.

Figure 14:
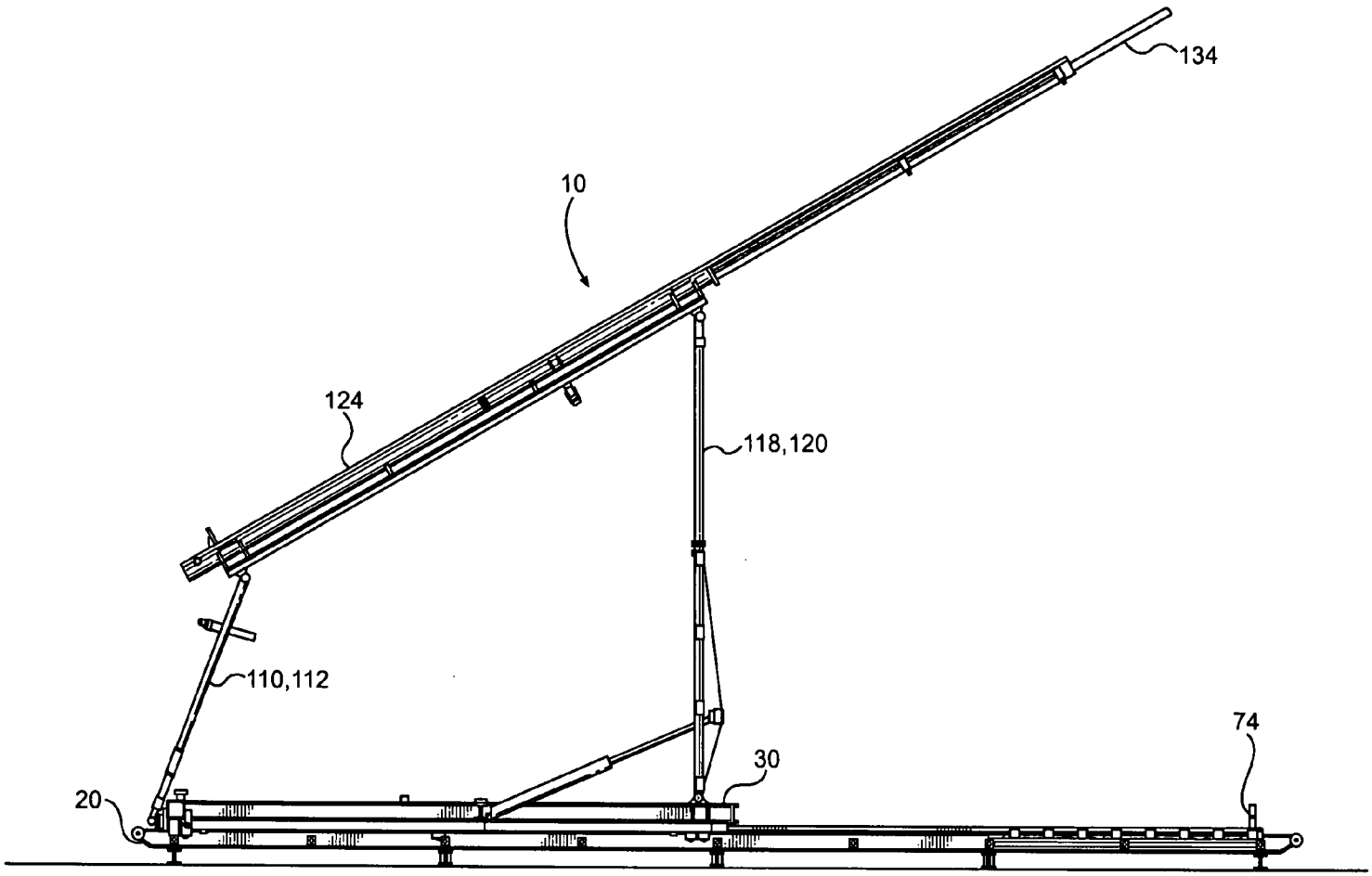
FIG. 14 illustrates extension of the pipe loader assembly along the base.
Figure 15:
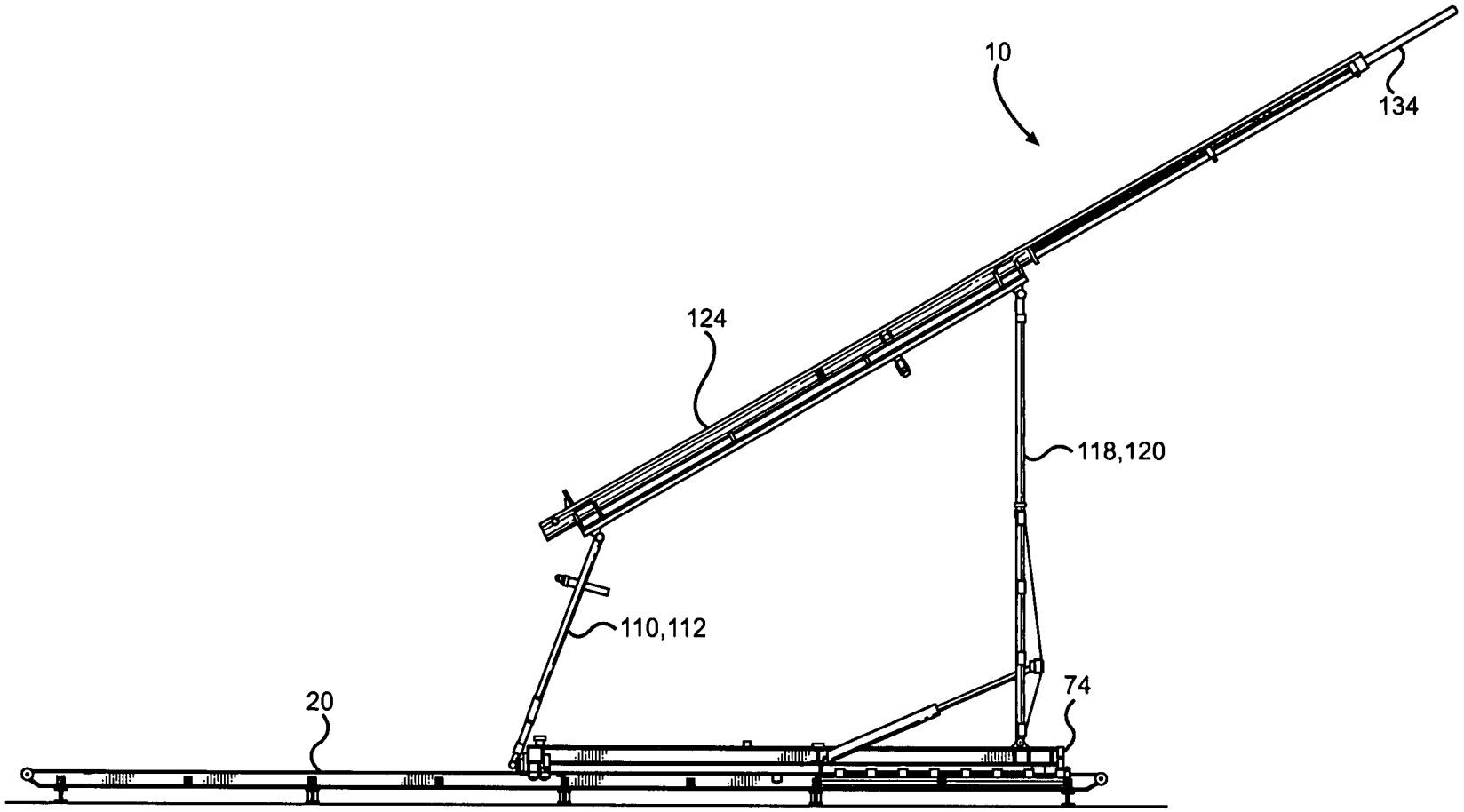
FIG. 15 illustrates retraction of the pipe loader moving assembly.

FIGS. 10, 14 and 15 illustrate the forward struts 118, 120 further extended in an upright position and lifting the trough 124 toward the floor 17 of the drilling rig 16. The pipe loader assembly 30 is then caused to move forward along the skid 20 using the sets of rollers mounted between the skid 20 and the pipe loader support assembly 30. The stop bar 74 can be successively moved forward using the receptacles 76 and 79 to prevent any possible rolling of the frame 32 downwardly.

As shown in FIG. 14, the forward struts are in a fully upright position, while the rear struts 110, 112 are fully extended to support a distant end of the trough 124. It is envisioned that the support assembly 30 is disposed to move about fifteen feet along the skid 20. In FIG. 15, the hydraulic cylinder 80 is fully retracted along the skid 20. The safety bar 74 prevents the support assembly 30 from advancing further than the starting position.

As shown in FIG. 10, the trough 124 is then caused to extend closer to the drilling floor 17. The platform workers can now use gripping tools to remove the tubular 134 from the trough 124 by sliding it away from the trough 124.

Once the tubular strand 134 is unloaded to the platform 16, the operator 300 activates the power source again, retracting the forward struts 118, 120 and lowering the trough 124 back to the stationary position. The process of loading the tubular into the trough and moving the tubular to the platform 16 is repeated several times until all required tubular strands have been incorporated into the job.

The apparatus of the present invention also provides a means for unloading the tubulars when they are no longer required on the rig 16 and depositing them onto the storage rack 126. To facilitate the unloading process, the apparatus 10 is provided with a plurality of unloading arms 150 secured adjacent the edge 127 of the trough 124. It will be understood that the positioning of the loading arms 130 and the unloading arms 150 relative to the edges of the trough 124 can be easily reversed since both the loading arms 130 and the unloading arms 150 are detachably engaged with the trough 124.

Figure 29:
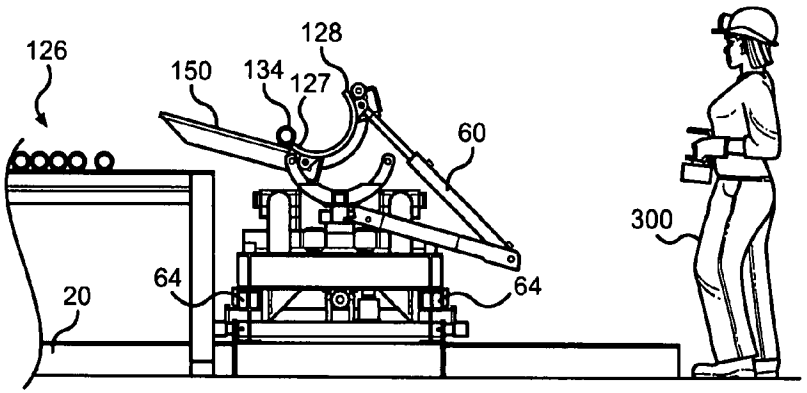
FIG. 29 is a detail end view illustrating the tilted trough with a pipe moving along the unloading arm.
Figure 28:
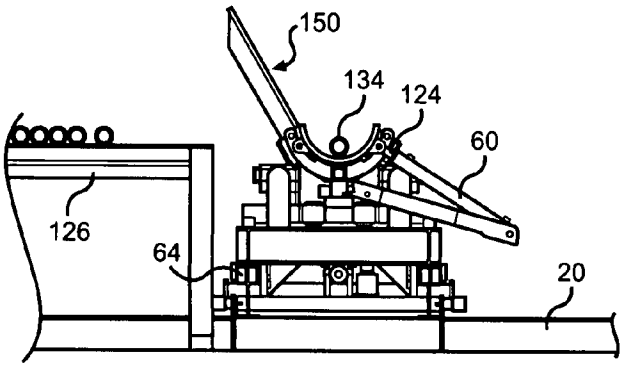
FIG. 28 is a detail end view illustrating the trough with a pipe segment ready to be unloaded.
Figure 30:
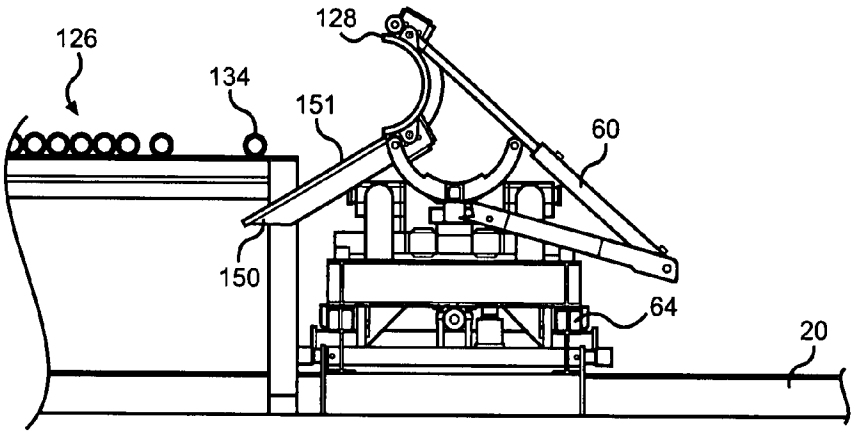
FIG. 30 is a detail end view illustrating the tilted trough with the unloaded pipe segment.
Figure 32:
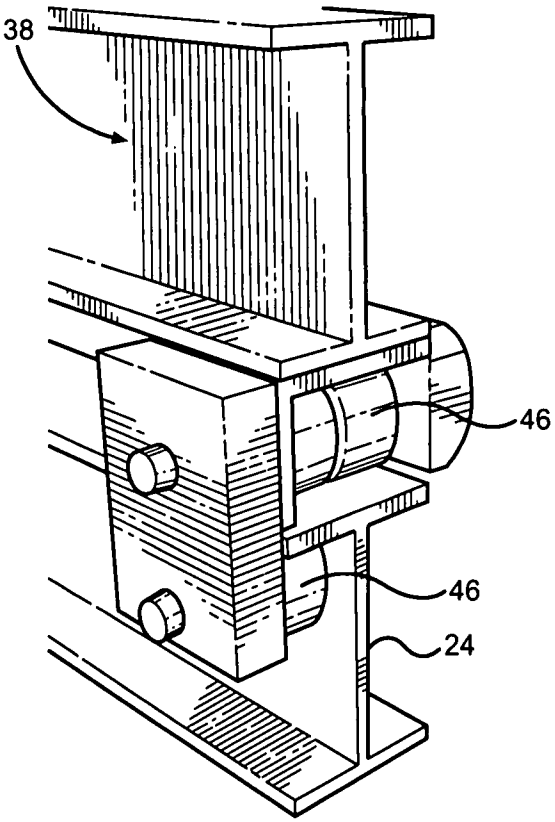
FIG. 32 is a detail perspective view illustrating a single roller set assembly mounted between the skid and the pipe loader base.

As illustrated in FIGS. 28-30, the articulate pivot assemblies 60 are now located on the "left" side of the trough 50. Each of the unloading arms 150 comprises a generally planar upper surface 151 which can be covered with a protective coating so as to avoid damage to the tubular exterior. Each of the unloading arms 150 is oriented to extend at a tangent to a side of the arcuate trough 124 adjacent either edge 127 or 128. In this exemplary illustration, the unloading arms 150 are detachably secured to the underside of the trough 124 and extend upwardly in relation to the edge 127.

Figure 25:
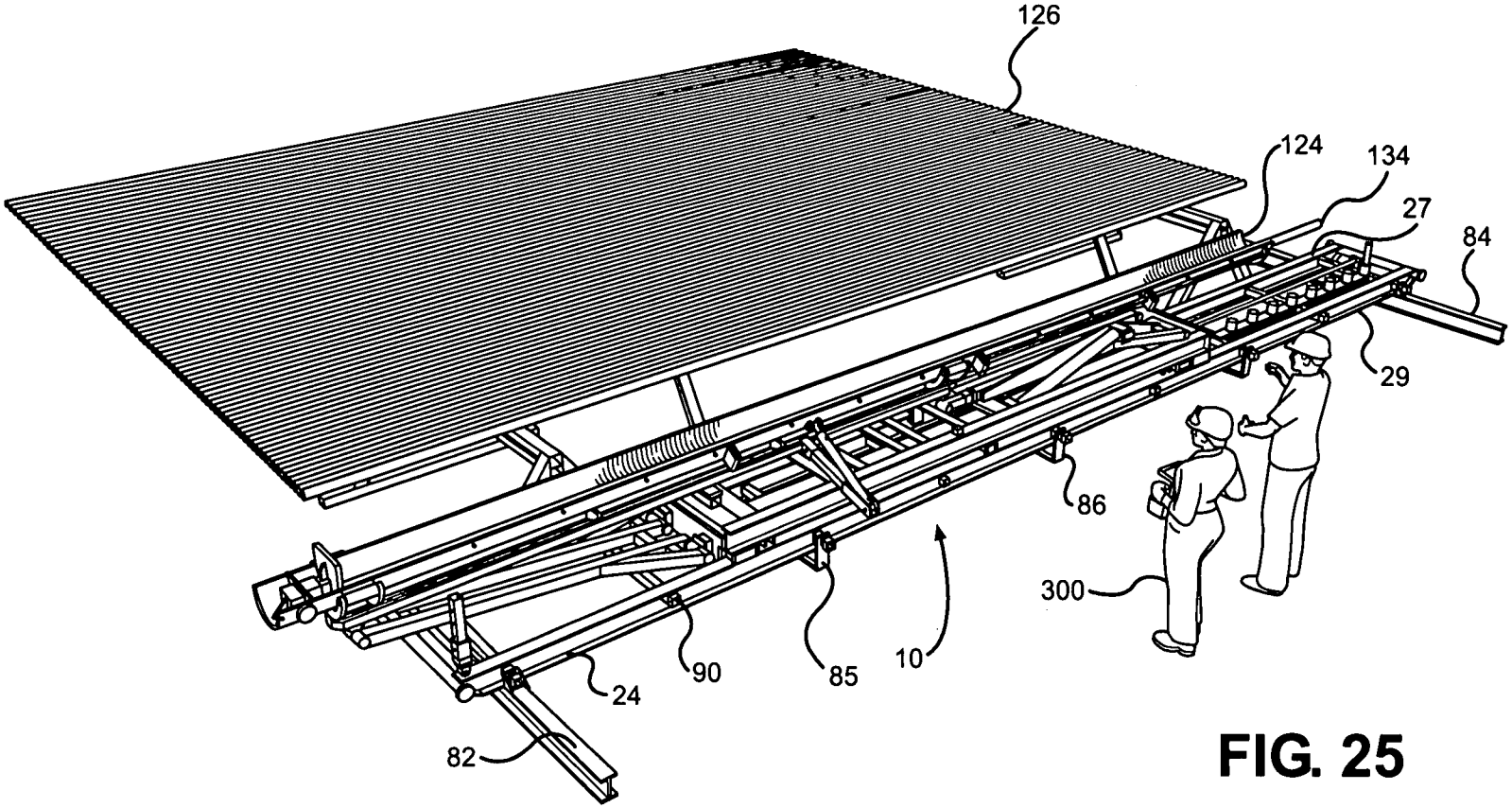
FIG. 25 is a perspective view illustrating position of the pipe tray in a starting position before unloading the pipe.
Figure 26:
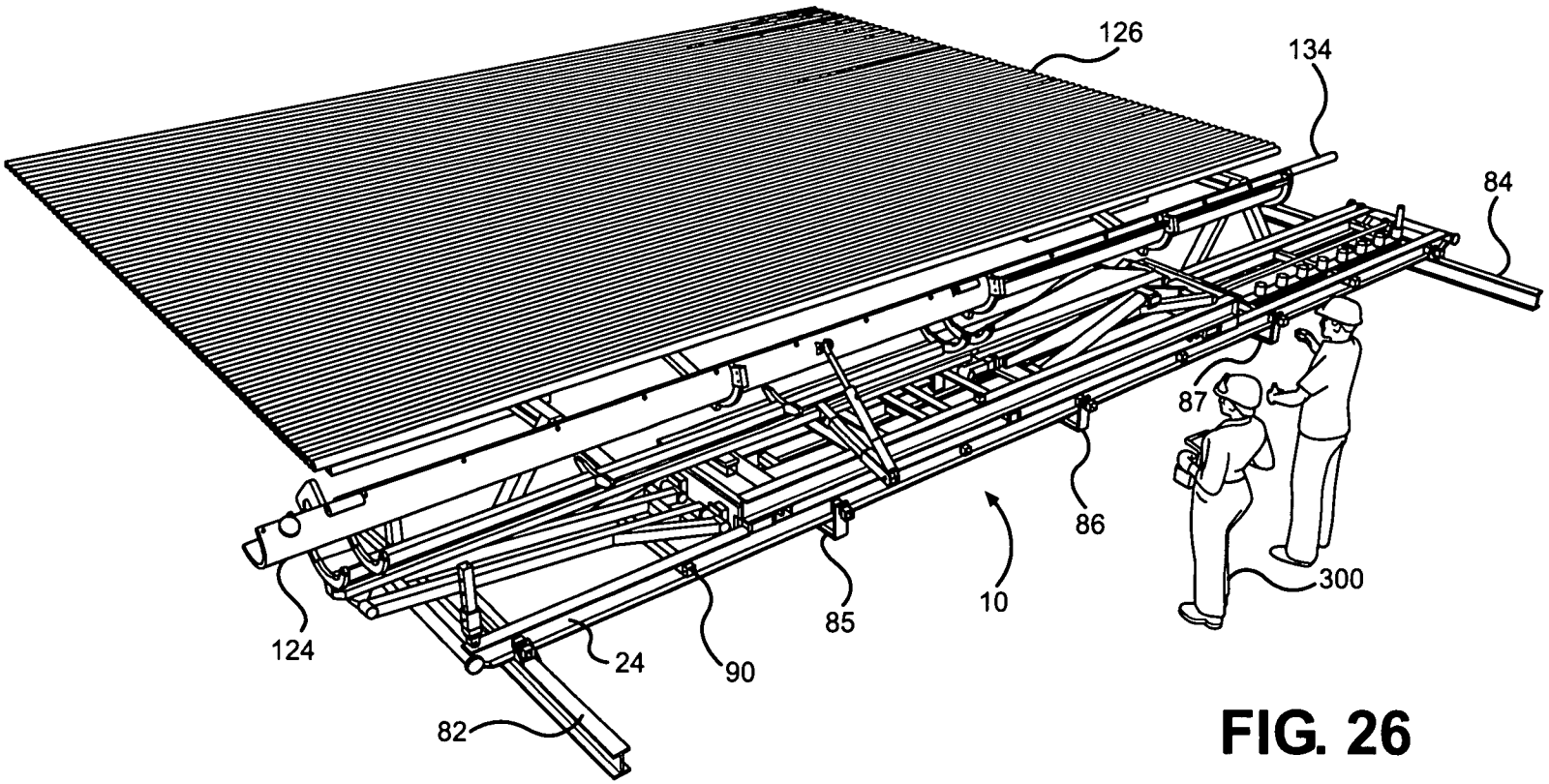
FIG. 26 is a perspective view illustrating the pipe tray rotated 45 degrees beginning to unload the pipe.

When the drill string (or other lengths of tubular) is removed from a wellbore and is broken, it presents itself as a plurality of tubular strands that are usually stacked on the rack 126. As shown in FIGS. 25 and 28, the rack 126 is ready to receive the tubular strands 134. The apparatus 10 is again positioned adjacent the rack 126 which is maneuvered to be close enough to the rig 16 and capable of moving between a fully extended position shown in FIG. 10 to a retracted position.

Figure 27:
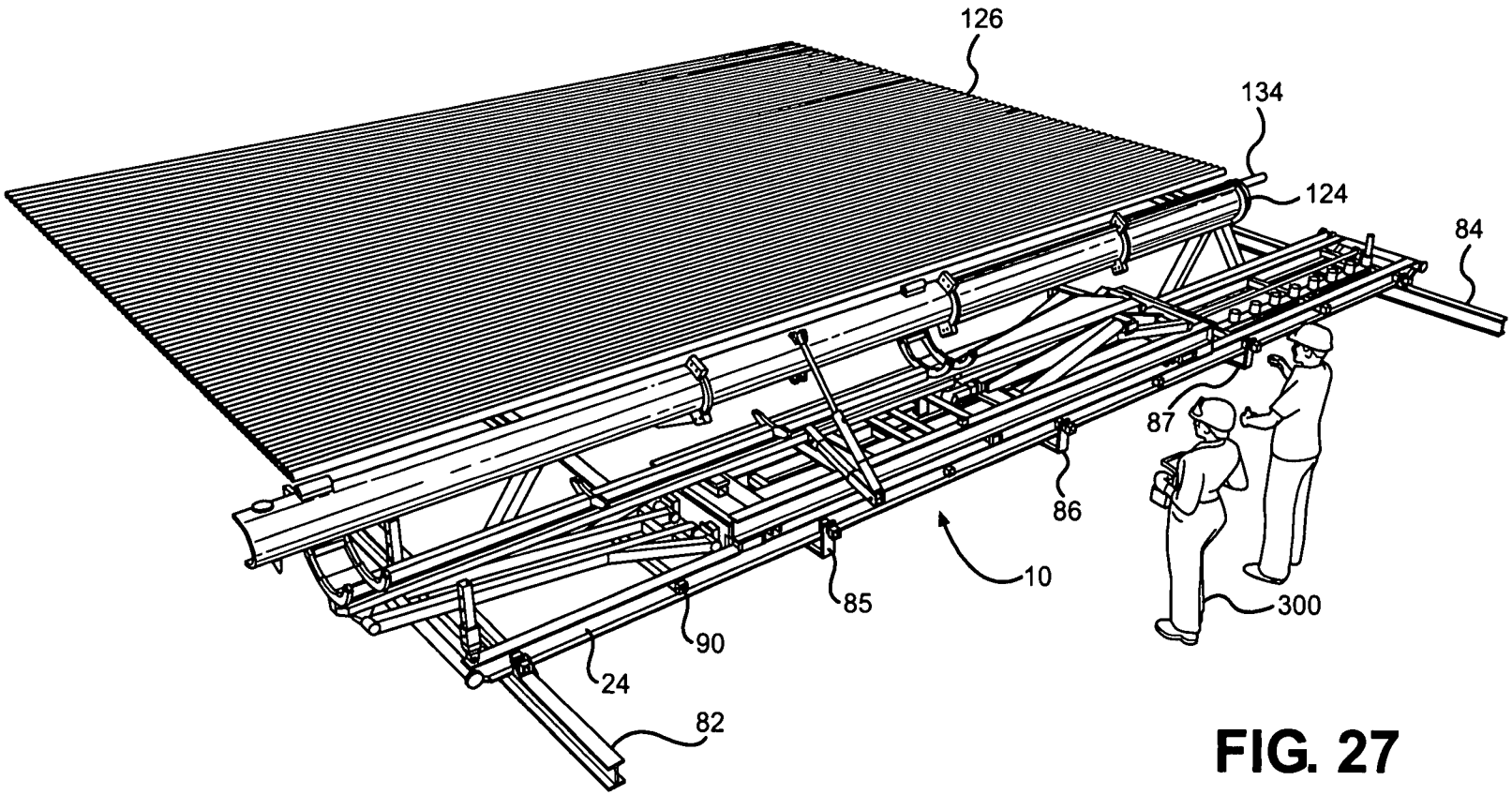
FIG. 27 is a perspective view illustrating the pipe tray rotated 90 degrees to unload the pipe.

The tubular strand 134 deposited into the trough 124 at the platform floor is lowered to the rack 126, as shown in FIGS. 25-30. The operator 300 activates the pivot assemblies 60 to tilt the trough 124 to a position shown in FIGS. 26 and 29, at 45 degrees in relation to the base 20 in order to begin unloading of the tubular 134. Since the upper surface 151 of the unloading arm 150 forms an extension of the edge 127, the tubular strand 134 is allowed to roll along the upper surface 151. Further tilting of the trough 134 by the pivot assemblies 60 causes the unloading arm 150 to pivot 90 degrees in relation to the base 20, as shown in FIGS. 27 and 30. The tubular strand 134 thus rolls under gravity onto the rack 126. The process of bringing the tubular strands from the rig 16 continues using the rolling support assembly 30 until all tubulars are properly stored.

It is envisioned that the power source for operating the apparatus of the present invention can be pneumatics or geared electric motor. The use of loading and unloading arms allows to reduce the number of workers operating the pipe handling apparatus, thus substantially reducing the cost of the operation. Provision of multiple safety features ensures easy movement of the support structure along the base.

Many changes and modifications can be made in the apparatus and method of the present invention. I, therefore, pray that my rights to the present invention be limited only by the scope of the appended claims.

I claim:

1. An apparatus for moving a tubular member, comprising:

a base configured to be positioned adjacent a storage rack containing a plurality of tubular members;

an articulated trough support structure mounted on the base and having trough support members movable between a folded stationary position and an upright extended position;

a means for slidably moving the support structure along the base;

an arcuate elongated trough extending longitudinally along the support structure, said trough having opposite parallel side edges and configured to receive the tubular member;

a plurality of spaced-apart removable loading arms secured to a side edge of the trough and extending at an obtuse angle in relation to a side edge of the trough, said loading arms moving the tubular member between the storage rack and the trough;

a plurality of spaced-apart removable unloading arms secured to another side edge of the trough and extending at a tangent to a side of the trough, said unloading arms moving the tubular member between the trough and the storage rack; and wherein the side edge of the trough and the another side edge of the trough are parallel.

2. The apparatus of claim 1, said means for slidably moving the support structure comprises a plurality of rollers disposed between the base and the articulated support structure.

3. The apparatus of claim 2, wherein said plurality of rollers is secured to an underside of the support structure.

4. The apparatus of claim 1, comprising means for pivotally moving the trough in relation to the support structure during loading and unloading of the tubular member from the storage rack into the trough and from the trough to the storage rack.

5. The apparatus of claim 4, said means for pivotally moving the trough comprises pivot assemblies mounted to an underside of the trough and imparting pivotal movement on the trough during loading and unloading of the tubular member to and from the trough.

6. The apparatus of claim 1, comprising a means for moving the trough support members between a folded position and an unfolded upright position.

7. The apparatus of claim 6, said means for moving the trough support members between a folded position and an unfolded upright position comprises a plurality of extendable foldable pivotally movable struts secured to an underside of the trough.

8. The apparatus of claim 7, wherein said struts comprise hydraulically movable struts.

9. The apparatus of claim 1, the articulated trough support structure comprising a frame slidably movable along the base.

10. The apparatus of claim 9, comprising a means for limiting sliding movement of the frame in relation to the base.

11. The apparatus of claim 10, said means for limiting sliding movement comprising a stop bar detachably secured to the base and extending upwardly in relation to the frame.

12. The apparatus of claim 1, comprising a plurality of leg assemblies detachably securable to the base, the leg assemblies being disposed to rest on the ground and level position of the base on the ground.

13. The apparatus of claim 12, the base being provided with a plurality of laterally spaced-apart leg engaging members, said leg engaging members being disposed to detachably engage with leg assemblies.

14. The apparatus of claim 1, wherein each of the loading arms comprises a substantially L-shaped body.

15. The apparatus of claim 1, wherein each of the unloading arms comprises a substantially planar upper surface.

16. The apparatus of claim 1, said trough having a semicylindrical configuration.

17. An apparatus for moving a tubular member to and from a storage rack, comprising:

a base configured to be positioned adjacent the storage rack containing a plurality of tubular members;

an articulated trough support structure mounted on the base and having a frame and trough support members mounted on the frame and movable between a folded stationary position and an upright extended position, said trough support members comprising a plurality of extendable pivotal foldable struts;

a means for slidably moving the support structure along the base comprising a plurality of rollers secured to an underside of the support structure;

an arcuate elongated trough extending longitudinally along the support structure, said trough having opposite parallel side edges and configured to receive the tubular member;

a plurality of spaced-apart removable loading arms secured to a side edge of the trough and extending at an obtuse angle in relation to a side edge of the trough, said loading arms moving the tubular member between the storage rack and the trough;

a plurality of spaced-apart removable unloading arms secured to another side edge of the trough and extending at a tangent to a side of the trough, said unloading arms moving the tubular member between the trough and the storage rack; and wherein the side edge of the trough and the another side edge of the trough are parallel.

18. The apparatus of claim 17, comprising a plurality of leg assemblies detachably securable to the base, the leg assemblies being disposed to rest on the ground and level position of the base on the ground.

19. The apparatus of claim 18, the base being provided with a plurality of laterally spaced-apart leg engaging members, said leg engaging members being disposed to detachably engage with leg assemblies.

20. The apparatus of claim 17, comprising means for pivotally moving the trough in relation to the support structure during loading and unloading of the tubular member from the storage rack into the trough and from the trough to the storage rack, said means for pivotally moving the trough comprising pivot assemblies mounted to an underside of the trough and imparting pivotal movement on the trough during loading and unloading of the tubular member to and from the trough.

21. The apparatus of claim 17, corn rising a means for limiting sliding movement of the frame in relation to the base, said means for limiting sliding movement comprising a stop bar detachably secured to the base and extending upwardly in relation to the frame.

22. The apparatus of claim 21, comprising a plurality of spaced sleeves secured to the base below the frame and disposed to selectively receive the stop bar therein.

23. The apparatus of claim 17, wherein each of the loading arms comprises a substantially L-shaped body and having contact surfaces carrying a protective coating.

24. The apparatus of claim 17, wherein each of the unloading arms comprises a substantially planar upper surface having a protective coating.

25. The apparatus of claim 17, said trough having a semicylindrical configuration.

26. method of moving a tubular member between a horizontal storage rack and an elevated floor of a platform, the method comprising the steps of:

providing a pipe handling apparatus comprising a base configured to be positioned adjacent a storage rack containing a plurality of tubular members, an articulated trough support structure mounted on the base and having trough support member movable between a folded stationary position and an upright position reaching to the elevated platform floor, an arcuate elongated trough extending longitudinally along the support structure, a plurality of spaced-apart removable loading arms secured to a side edge of the trough and extending at an obtuse angle in relation to a side edge of the trough, a plurality of spaced-apart removable unloading arms secured to another side edge of the trough and extending at a tangent to a side of the trough, the side edge of the trough and the other side edge of the trough are parallel;

providing a means disposed between the base and the trough support structure for slidably moving the trough support structure along the base;

actuating said loading arms and moving the tubular strand from the storage rack into the trough; and actuating the support structure and elevating the trough with the tubular member to the floor of the platform, while moving the trough support structure along the base toward the platfbrm floor.

27. The method of claim 26, comprising a step of moving the tubular member from the platform floor to the storage rack.

28. The method of claim 27, wherein the step of moving the tubular member from the platform floor to the storage rack comprises actuating the support structure and elevating the trough to the platform floor, depositing the tubular member into the trough, lowering the support structure, actuating the unloading arms and moving the tubular member from the trough onto the storage rack along the unloading arms.

29. The method of claim 26, said trough support structure comprising a frame and a plurality of extendable pivotal foldable struts secured to the frame and engaging the trough.

30. The method of claim 26, comprising a step of providing pivot assemblies affixed to the trough and imparting pivotal movement on the trough during loading and unloading of the tubular member to and from the trough.

31. The method of claim 26, wherein each of the loading arms comprises a substantially IL-shaped body and each of the unloading arms comprises a substantially planar upper surface.

32. The method of claim 26, said trough having a semi lindrical configuration.

33. The method of claim 26, comprising a step of providing a plurality of leg assemblies detachably securable to the base, positioning the leg assemblies on the ground adjacent the storage rack and leveling position of the base on the ground.

34. The method of claim 33, wherein the base is provided with a plurality of laterally spaced-apart leg engaging members, said leg engaging members being disposed to detachably engage with leg assemblies.

35. The method of claim 34, comprising a step of selectively engaging the leg assemblies with selected leg engaging members so as to level position of the base on the ground.

36. An apparatus for moving a tubular member, comprising:

a base configured to be positioned adjacent a storage rack containing a plurality of tubular members;

an articulated trough support structure mounted on the base, said support structure comprising trough support members movable between a folded stationary position and an upright extended position and a frame slidably movable along the base;

a means for slidably moving the support structure along the base;

an arcuate elongated trough extending longitudinally along the support structure, said trough having opposite parallel side edges and configured to receive the tubular member;

a plurality of spaced-apart removable loading arms secured to a side edge of the trough and extending at an obtuse angle in relation to a side edge of the trough, said loading arms moving the tubular member between the storage rack and the trough;

a plurality of spaced-apart removable unloading arms secured to another side edge of the trough and extending at a tangent to a side of the trough, said unloading arms moving the tubular member between the trough and the storage rack;

a means for limiting sliding movement of the frame in relation to the base, said means for limiting sliding movement comprising a stop bar detachably secured to the base and extending upwardly in relation to the frame; and a plurality of spaced sleeves secured to the base below the frame and disposed to selectively receive the stop bar therein.

37. A method of moving a tubular member between a horizontal storage rack and an elevated floor of a platform, the method comprising the steps of:

providing a pipe handling apparatus comprising a base configured to be positioned adjacent a storage rack containing a plurality of tubular members, an articulated trough support structure mounted on the base and having trough support member movable between a folded stationary position and an upright position reaching to the elevated platform floor, an arcuate elongated trough extending longitudinally along the support structure, a plurality of spaced-apart removable loading arms secured to a side edge of the trough and extending at an obtuse angle in relation to a side edge of the trough, a plurality of spaced-apart removable unloading arms secured to another side edge of the trough and extending at a tangent to a side of the trough;

providing a means disposed between the base and the trough support structure for slidably moving the trough support structure along the base;

actuating said loading arms and moving the tubular strand from the storage rack into the trough;

actuating the support structure and elevating the trough with the tubular member to the floor of the platform, while moving the trough support structure along the base toward the platform floor; and providing a means for limiting sliding movement of the frame in relation to the base, said means for limiting sliding movement comprising a stop bar detachably secured to the base and extending upwardly in relation to the frame and a plurality of spaced sleeves secured to the base below the frame and disposed to selectively receive the stop bar therein.

* * * * *